US006908182B2

(12) United States Patent
Nakazawa et al.

(10) Patent No.: US 6,908,182 B2
(45) Date of Patent: Jun. 21, 2005

(54) INK CARTRIDGE AND INK JET PRINTER

(75) Inventors: Chiyoshige Nakazawa, Nagano (JP); Manabu Yamada, Nagano (JP); Tomoji Suzuki, Nagano (JP); Kazuyuki Yokoyama, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/771,942

(22) Filed: Jan. 30, 2001

(65) Prior Publication Data

US 2001/0040613 A1 Nov. 15, 2001

(30) Foreign Application Priority Data

| | | |
|---|---|---|
| Jan. 31, 2000 | (JP) | P2000-022896 |
| Mar. 17, 2000 | (JP) | P2000-077108 |
| Apr. 21, 2000 | (JP) | P2000-121455 |
| Jun. 6, 2000 | (JP) | P2000-169244 |

(51) Int. Cl.[7] ..... B41J 2/175
(52) U.S. Cl. ..... 347/86
(58) Field of Search ..... 347/31, 37, 85–87

(56) References Cited

U.S. PATENT DOCUMENTS

| | | | | | |
|---|---|---|---|---|---|
| 4,695,824 A | * | 9/1987 | Tazaki | 347/86 |
| 4,695,851 A | * | 9/1987 | Terasawa | 347/30 |
| 4,855,762 A | * | 8/1989 | Suzuki | 347/86 |
| 5,666,146 A | | 9/1997 | Mochizuki et al. | 347/86 |
| 5,907,343 A | * | 5/1999 | Takemura et al. | 347/108 |
| 6,095,630 A | | 8/2000 | Horii et al. | 347/10 |
| 6,106,112 A | * | 8/2000 | Okubo et al. | 347/86 |
| 6,281,911 B1 | * | 8/2001 | Nakazawa et al. | 347/36 |

FOREIGN PATENT DOCUMENTS

| | | |
|---|---|---|
| EP | 0 364 284 | 4/1990 |
| EP | 0 419 876 | 4/1991 |
| EP | 0 791 463 | 8/1997 |
| EP | 0 928 694 | 7/1999 |
| JP | 62-126938 | 8/1987 |
| JP | 63-116833 | 5/1988 |
| JP | 5-16377 | 1/1993 |
| JP | 5-162333 | 6/1993 |
| JP | 6-969 | 1/1994 |
| JP | 6-99588 | 4/1994 |
| JP | 11-70655 | 3/1999 |
| JP | 11-70672 | 3/1999 |
| JP | 11-138834 | 5/1999 |

* cited by examiner

*Primary Examiner*—Michael Nghiem
(74) *Attorney, Agent, or Firm*—Nixon & Vanderhye P.C.

(57) ABSTRACT

An ink cartridge, for an ink jet printer, having a cartridge case, first and second ink bags housed in the cartridge case, and a partition plate placed between the ink bags. The partition plate is dropped into a case main body of the cartridge case through an upper opening of the case main body. When a case lid is attached to the case main body, the partition plate is sandwiched between rib upper end faces of the case main body and an outer frame end face of the case lid so that the position of the partition plate is fixed. Ink outlet parts, of the ink bags, are overlaid on each other in a case thickness direction so that they are in contact with each other without intervention of the partition plate. Therefore, the ink cartridge is miniaturized and can be easily disassembled when it is recycled.

14 Claims, 22 Drawing Sheets

INK CARTRIDGE AND INK JET PRINTER

BACKGROUND OF THE INVENTION

1. Field of the Invention

This invention relates to an ink cartridge used as an ink supply source of an ink jet printer and, in particular, to an ink cartridge comprising a configuration adequate for recycling and a configuration adequate for miniaturization. The present invention also relates to an ink jet printer using the above-described ink cartridge.

2. Description of the Related Art

A known ink supply mechanism of an ink jet printer is as follows An ink supply needle is placed in an ink cartridge placement part formed in an ink jet printer and, if an ink cartridge is placed so that the ink supply needle is inserted into an ink outlet formed in the ink cartridge, ink stored in the ink cartridge can be supplied to an ink jet head of the ink jet printer.

The ink cartridges used with such an ink jet printer are disclosed in JP-A-63-116833, JP-A-5-162333, JP-A-11-70672, etc. For example, the ink cartridge disclosed in JP-A-11-70672 comprises a cartridge case housing an ink back and a waste-ink absorption material, and a detection plate—for detecting when the amount of ink, remaining in the ink bag, gets low—is attached to the ink bag.

Some ink jet printers require two or more ink cartridges. For example, ink cartridges housing ink bags storing different color inks need to be placed in an ink jet printer for executing color printing.

However, if two ink cartridges are placed in the ink jet printer, it becomes cumbersome to attach and detach the ink cartridges and the ink cartridge placement part is upsized.

Thus, to simplify the ink cartridge placement operation and miniaturize the ink cartridge placement part, an ink cartridge housing two or more ink bags may be used. In this case, to make it possible to house the ink bags at the determined positions, and possible precisely to detect the amount of ink remaining in each ink bag by means of a detection plate attached thereto, the cartridge case may be divided into two partitions by a partition plate so that the ink bags separately are housed in the partitions.

However, to use the ink cartridge housing a plurality of ink bags, if any one of the ink bags becomes empty of ink, the ink cartridge needs to be replaced regardless of how much ink remains in any other ink bag. Therefore, it is extremely uneconomical to replace the ink cartridge if a large amount of ink remains in any ink bag other than the empty one. Generally, black ink is consumed in larger quantities than is colored ink and, thus, the ink cartridge must be replaced without entirely consuming the colored ink.

On the other hand, in recent years, for environmental protection, it has been desired that in so far as possible an ink cartridge be made up of recyclable parts. From this viewpoint, to recycle a cartridge case, it is desired that the cartridge case designed for easy disassembling.

SUMMARY OF THE INVENTION

It is an object of the invention to provide an ink cartridge comprising a plurality of ink bags advantageous for miniaturization.

It is another object of the invention to provide an ink cartridge comprising a plurality of ink bags intended to facilitate disassembly work at recycling time.

It is still another object of the invention to provide an ink cartridge comprising a plurality of ink bags advantageous for miniaturization, wherein ink outlets of the ink bags can be positioned reliably.

It is still yet another object of the invention to provide an ink cartridge comprising a plurality of ink bags that can be easily attached and detached from one another.

It is a further object of the invention to provide an ink cartridge comprising a plurality of ink bags intended for reducing waste-ink in the ink bags.

On the other hand, it is an object of the invention to provide an ink jet recorder using such a new ink cartridge as an ink supply source.

To accomplish the above-mentioned and other objects, according to the invention there is provided an ink cartridge including:

a cartridge main body having a first case and a second case joined to the first case;

at least first and second ink bags, each having a bag main body storing ink, and an outlet through which the ink can be discharged from the bag main body, one or a plurality of the ink bags being housed in either or both of the first case and the second case, wherein when the first case and the second case are joined, the outlets of the first and second ink bags are pressed against each other by the first case and the second case.

Generally, the outer size of the ink outlet is larger than the thickness of the bag main body when the ink bag is filled with ink. Therefore, if the ink outlet parts are stacked in the case thickness direction so that they contact one another, the thickness of the ink cartridge can be reduced. This structure is particularly advantageous for miniaturization of an ink cartridge in which three or more ink bags are housed.

As one method for providing such an ink cartridge, the first case may be a case main body having a bottom plate portion and a side plate portion with an opening on its top for housing the first and second ink bags. Further, the second case may be a case lid for covering the opening of the case main body. In this case, the ink outlet parts are stacked in the case thickness direction without intervention of a partition plate, and the thickness of the ink cartridge can be reduced as much as the thickness of the partition plate.

In addition to the above-described configuration, it is also effective that a partition plate, for separating the housing space of the first ink bag and the housing space of the second ink bag, is attached to a predetermined position of the case main body. In this case, the partition plate prevents the first ink bag and the second ink bag from interfering with each other. Thus, a failure wherein ink flows out from the lower ink bag because the weight of the upper ink bag presses the lower ink bag, for example, or the like, can be prevented.

It is desirable that the partition plate be placed movably in the thickness direction of the case main body along the side plate portion and the case main body, and that the case lid comprise partition plate clamp faces for defining the position of the partition plate by clamping the partition plate.

According to the above configuration, the partition plate does not mechanically engage the case main body as like a snap-fit, etc. Therefore, in disassembly at recycling time, the partition plate can be easily detached from the case main body after the case lid is opened. Also, at assembly time, the partition plate may be simply dropped inside the case main body through the upper opening thereof.

Further, it is desirable that a waste-ink holding member, for storing waste ink poured therein from the outside, be attached to the case lid. According to this configuration, when the maximum amount of waste ink is stored, only the case lid may need to be replaced.

To fix the ink outlets of the ink bags to determined positions, the case main body and the case lid may comprise ink outlet clamp faces that define the positions of the ink outlets by clamping the ink outlets in stacked relation on each other. In this case, to make it possible to reliably clamp the ink outlets without rattle, it is desirable that at least one of the ink outlet clamp faces be made elastically displaceable.

Next, to reliably fix the partition plate to a predetermined position, the ink outlet of each ink bag may be used to fix the partition plate. That is, it is desirable that each ink outlet should comprise a partition plate clamp face for defining the position of the partition plate.

In this case, it is desirable that each of the ink outlets comprise a portion (stacked in the case thickness direction without intervention of the partition plate) and a partition plate clamp portion (stacked in a state in which a part of the partition plate is clamped), and that the partition plate clamp face should be formed in the partition plate clamp portion. In doing so, the partition plate can be reliably fixed, and the thickness of the ink cartridge can be reduced by as much as the thickness of the partition plate.

The ink cartridge of the invention can adopt a configuration in which each of the first and second ink bags has a detection plate that moves in the ink cartridge thickness direction in response to the amount of ink remaining in the corresponding ink bag. Further, first and second detection projections are extended in the thickness direction, of the bag main body, from the side margins of the first and second detection plates, wherein the detection projections and have tips projected from the rear of the case main body as the amounts of ink remaining in the first and second ink bags decrease. Moreover, the first and second detection projections differ from each other at least in shape or color.

On the other hand, the ink cartridge of the invention is characterized by the fact that the first case is a first ink cartridge for housing the first ink bag and the second case is a second ink cartridge for housing the second ink bag. The invention further comprising a joint mechanism fordetachably joining the first ink cartridge and the second ink cartridge.

According to this configuration, the ink cartridge of the invention comprises at least two ink cartridges detachably formed into one piece. Therefore, the cartridges can be attached to or detached from a cartridge placement section of an ink jet printer by one operation as with a single ink cartridge. If one ink cartridge becomes empty of ink, only the ink cartridge which becomes empty of ink need be replaced, so that the waste of ink can be eliminated.

The first ink cartridge can comprise the waste-ink holding member for storing waste ink in the first ink cartridge.

The joint mechanism can have snap fit parts formed in a side portion of the first ink cartridge and a side portion of the second ink cartridge.

According to the joint mechanism, both ink cartridges are overlaid and snap-fitted, whereby they can be joined easily. If the snap-fit part is thus formed in the side portion of the ink cartridge, the snap fit part is not directly grasped when the ink cartridge is handled.

The ink cartridge is pushed toward the front end face, whereby it is placed in the cartridge placement section of the ink jet printer. Thus, to prevent the first and second ink cartridges from shifting back and forth at the placement or removal time, it is desirable that the second ink cartridge be formed with a recess into which the first ink cartridge can be fitted in the thickness direction thereof, and that the first ink cartridge be placed in the recess.

Next, to detect a small amount of ink remaining in each ink bag, first and second detection plates—each moved in the thickness direction of the bag main body in response to the amount of ink remaining in the ink bag—may be attached to the first and second ink bags. Additionally, first and second detection projections may be extended in the thickness direction of the bag main body from the side margins of the first and second detection plates. Further, the detection projections may have tips projected from the rear of the second ink cartridge as the amounts of ink remaining in the first and second ink bags are reduced.

In this case, if either of the detection projections is projected from the rear of the ink cartridge, and the ink cartridge empty of ink is detected, to make it possible to immediately check which cartridge is empty of ink—by visual inspection of the detection projection of the ink cartridge after removing the cartridge from the cartridge placement section of the ink jet printer—it is desirable that the first and second detection projections differ from each other at least in shape or color.

It is effective to form the first ink cartridge with a side portion having a protection guide surrounding the first detection projection so that the detection projection is not broken or deformed when the first ink cartridge is not coupled to a second one.

To detect an ink-end condition with good accuracy, and to decrease the amount of ink remaining in the ink bag in the ink-end condition, it is desirable that the following configuration should be adopted:

First: the first and second detection plates are put on surfaces of the bag main bodies of the first and second ink bags, and the plane form of each detection plate overlapping the corresponding bag main body is rectangular; the width dimension of each detection plate—as measured in a direction along the side where the ink outlets of the first and second ink bags are attached—is a value within the range of 0.5 to 1.0 times the width dimension of the corresponding ink bag measured in the direction along the side where the ink outlets of the first and second ink bags are attached; and the length dimension of each detection plate is a value within the range of 0.4 to 0.8 times the length dimension of each ink bag.

Further, the ratio between: (i) the ratio between the lateral dimension of each detection plate and the lateral dimension of each ink bag; and (ii) the ratio between the longitudinal dimension of each detection plate and the longitudinal dimension of each ink bag, is within the range of 0.8 to 1.2.

Next, in the ink cartridge of the invention, it is desirable that the ink bag storing black ink, which is generally used most often, should be housed in the second ink cartridge having a larger capacity. And it is desirable that the ink bag of colored ink, which is relatively less often used, should be housed in the first ink cartridge having a smaller capacity as it also contains the waste-ink holding member.

Thus, according to the invention, ink cartridges are miniaturized, whereby the ink cartridge placement section can also be miniaturized, and it is made possible to provide a small-sized ink jet printer.

Also, according to the invention, there is provided an ink jet printer comprising;

an ink cartridge comprising a plurality of ink cartridges at least including a first ink cartridge for housing a first ink bag storing first ink and a second ink cartridge for housing a second ink bag storing second ink of a different color than the first ink and including an ink cartridge comprising a waste-ink holding member for storing waste ink poured therein from the outside, the plurality of ink cartridges being formed in one piece by a joint mechanism for detachably joining the plurality of ink cartridges;

a placement section in which the ink cartridge detachably is placed; and an ink jet head comprising a plurality of ink nozzle groups including a first ink nozzle group for ejecting the ink in the first ink bag of the ink cartridge placed in the placement section, and a second ink nozzle group for ejecting the ink in the second ink bag of the ink cartridge placed in the placement section for executing any desired printing on record paper relatively moved, wherein the waste-ink holding member is placed in the cartridge having the smallest value resulting from dividing the amount of ink in the ink bag housed in each ink cartridge by the number of nozzles of the ink nozzle group corresponding to the ink bag.

According to this configuration, the ink cartridge having a low probability of use is provided with the waste-ink holding member, so that the capacity of the waste-ink holding member can be used effectively. Also, the volume of the ink cartridge placement section can be reduced and the ink jet printer can be miniaturized as compared with the case where every ink cartridge includes a waste-ink holding portion.

It is desirable that the waste-ink holding member have a holding capacity in the range of 1 to 1.3 times a capacity found by multiplying: (i) the volume of ink available to the ink jet head as the amount of ink stored in the ink cartridge in which the waste-ink holding member is placed; by (ii) the total number of nozzles contained in the plurality of ink nozzle groups divided by the number of the ink nozzle groups for ejecting ink from the ink cartridge having the waste-ink holding member. According to this configuration, the waste-ink holding member becomes a small-sized waste-ink holding member capable of reliably preventing waste ink from leaking. Therefore, the volume of the ink cartridge is reduced, and the volume of the ink cartridge replacement section is reduced, whereby the ink jet printer can be miniaturized.

BRIEF DESCRIPTION OF THE DRAWINGS

The above and other objects and advantages of the present invention will become more apparent by describing in detail preferred exemplary embodiments thereof with reference to the accompanying drawings, wherein like reference numerals designate like or corresponding parts throughout the several views, and wherein.

DESCRIPTION OF THE PREFERRED EMBODIMENTS

Referring now to the accompanying drawings, there are shown preferred embodiments of ink cartridges incorporating the invention and ink jet printers using the ink cartridges as ink supply sources.

First Embodiment—an Ink Cartridge having a Partition Plate

Figure 1:
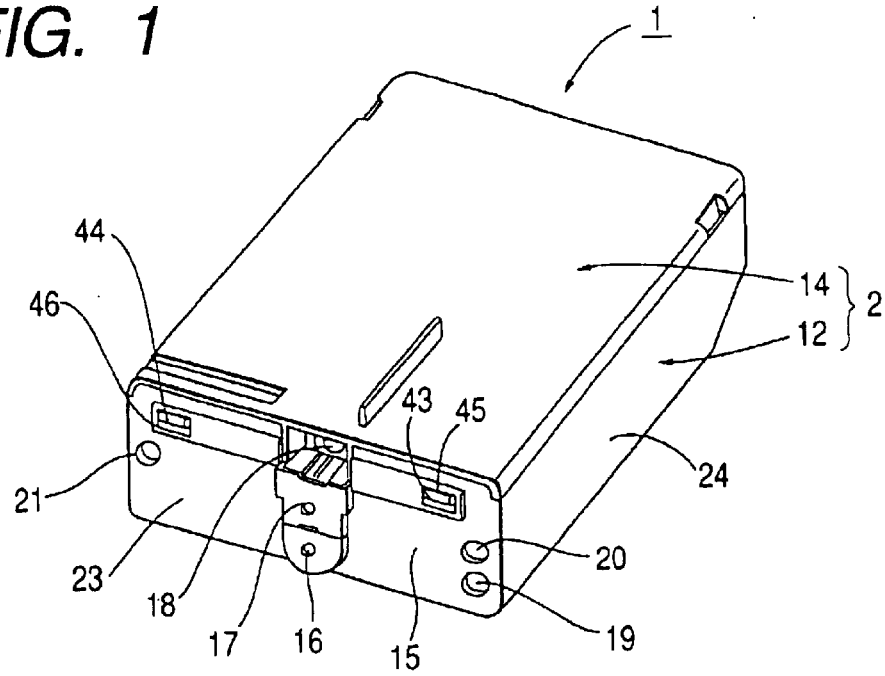
FIG. 1 is an external perspective view of an ink cartridge with a partition plate according to an embodiment of the invention when the ink cartridge is viewed from the top.
Figure 2:
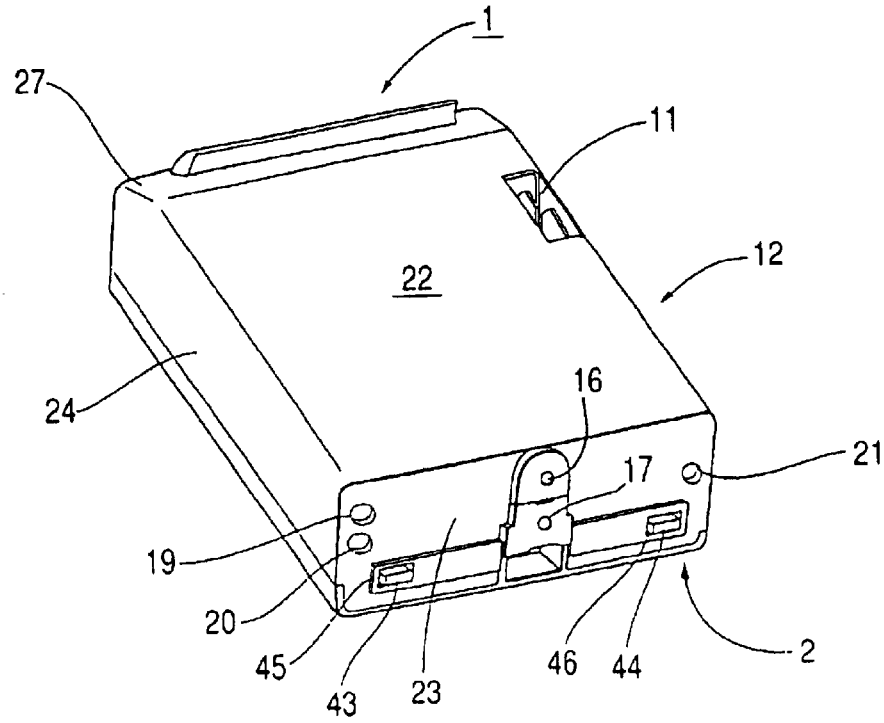
FIG. 2 is an external perspective view of the ink cartridge in FIG. 1 when the ink cartridge is viewed from the bottom.
Figure 3:
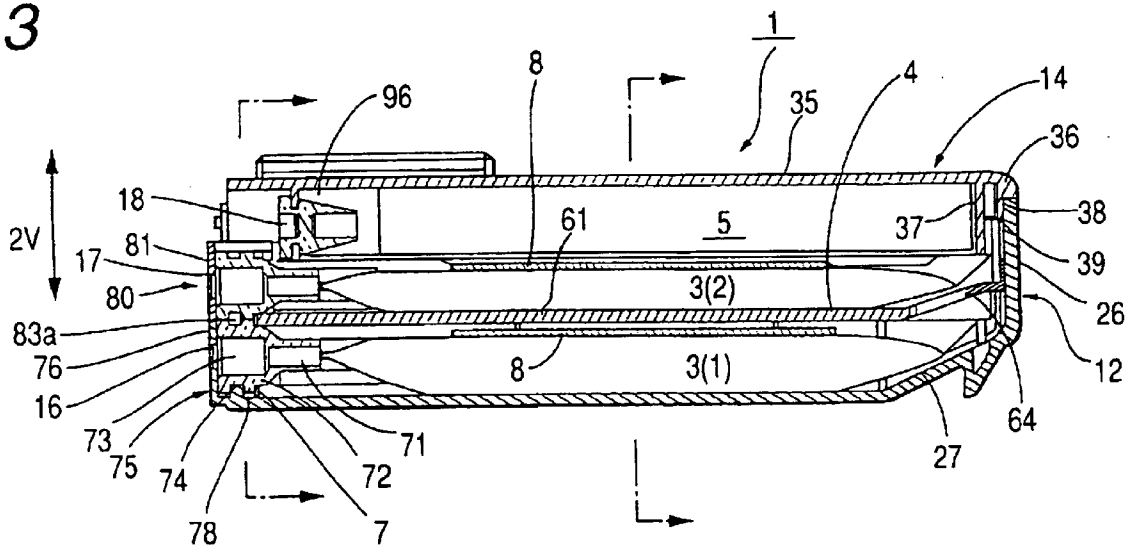
FIG. 3 is a longitudinal sectional view of the ink cartridge in FIG. 1.
Figure 4:
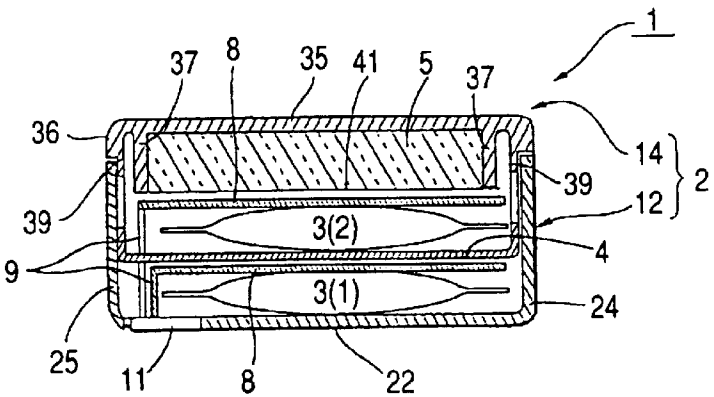
FIG. 4 is a transverse sectional view of the ink cartridge in FIG. 1.
Figure 5:
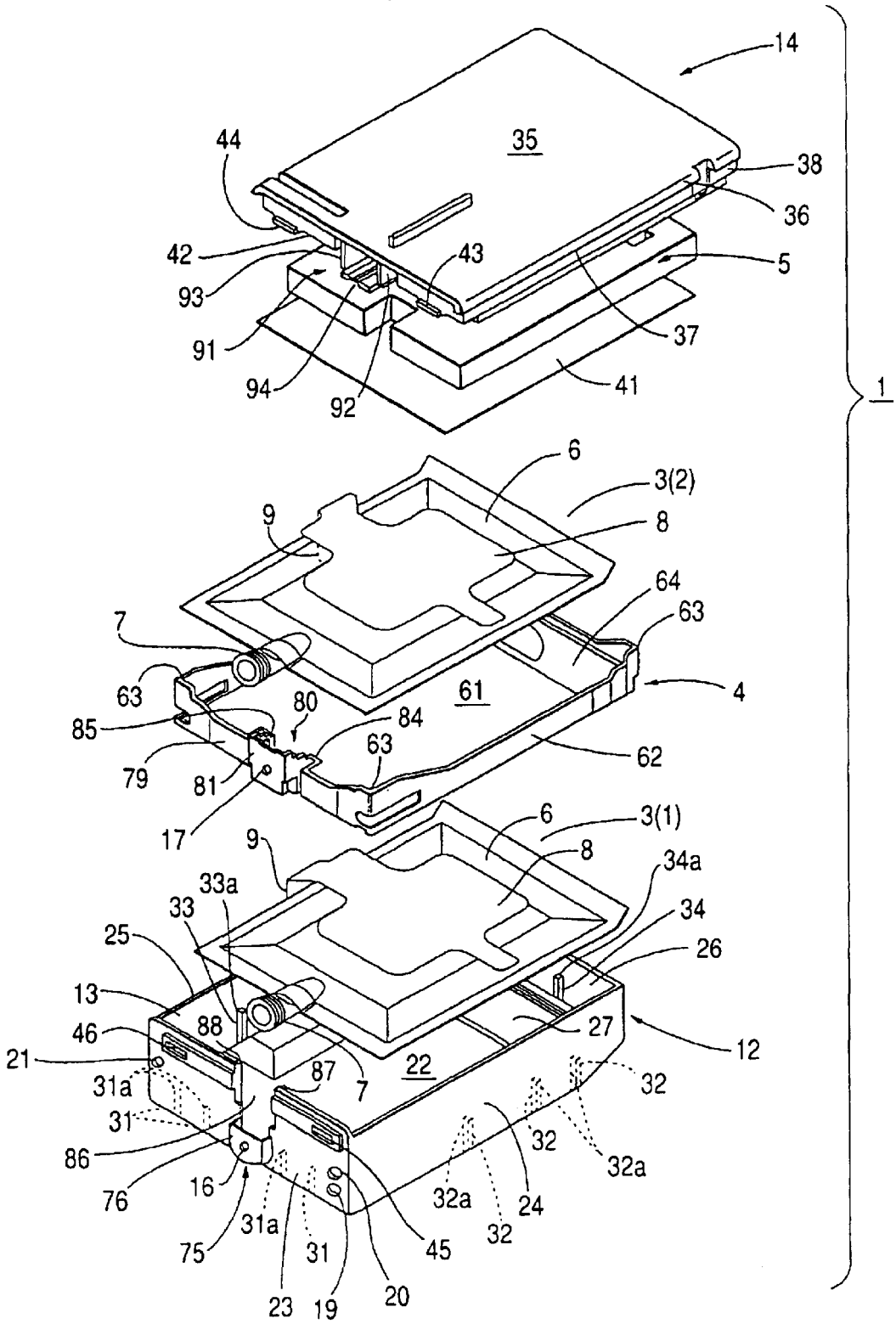
FIG. 5 is an exploded perspective view of the ink cartridge in FIG. 1.
Figure 6:
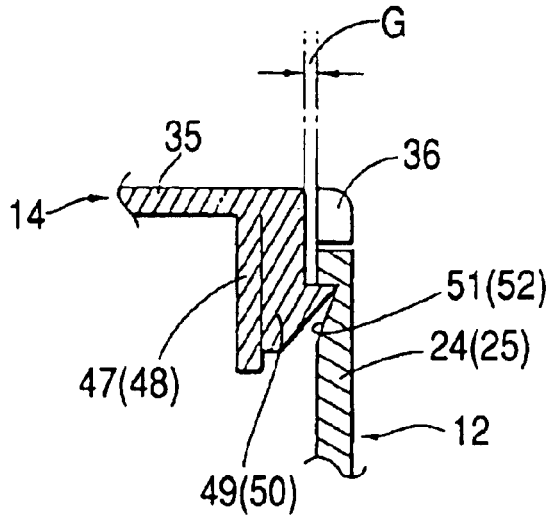
FIG. 6 is a fragmentary sectional view showing a snap fit portion of a case main body and a case lid of the ink cartridge in FIG. 1.
Figure 7:
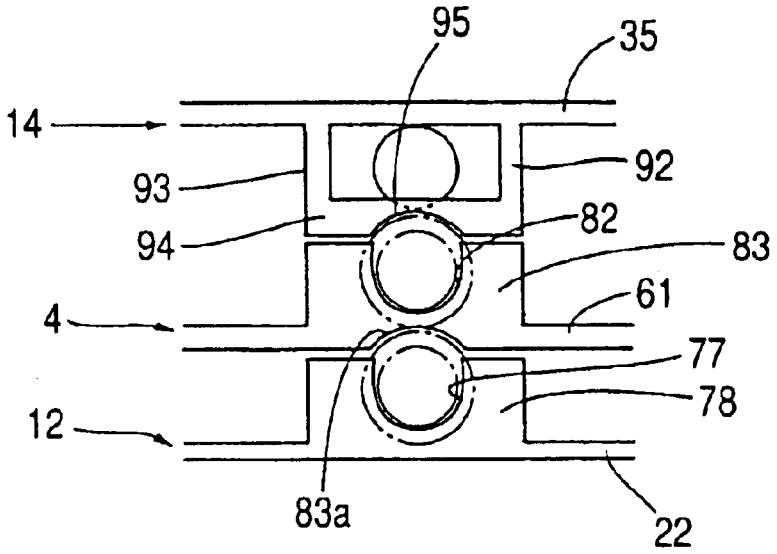
FIG. 7 is a schematic representation showing a fix structure of an ink outlet of the ink cartridge in FIG. 1.

FIG. 1 is an external perspective view of an ink cartridge with a partition plate according to an embodiment of the invention when the ink cartridge is viewed from the top. FIG. 2 is an external perspective view of the ink cartridge when the ink cartridge is viewed from the bottom. FIG. 3 is a longitudinal sectional view of the ink cartridge. FIG. 4 is a transverse sectional view of the ink cartridge. FIG. 5 is an exploded perspective view of the ink cartridge. FIG. 6 is a fragmentary sectional view showing a joint structure of a case main body and a case lid of a cartridge case. FIG. 7 is a schematic representation showing a structure by which ink outlets of ink bags are fixedly housed.

As shown in the figures, an ink cartridge 1 comprises a cartridge case 2 shaped like a fiat rectangular parallelepiped, first and second ink bags 3(1) and 3(2) housed in the cartridge case 2, a partition plate 4 placed between the ink bags, and a waste-ink absorption material 5.

First, the ink bags 3(1) and 3(2) are of the same structure and, therefore, only one ink bag 3(1) will be discussed. Parts of the ink bag 3(2) corresponding to those of the ink bag 3(1) are denoted by the same reference numerals and will not be discussed again. The ink bag 3(1) is formed of a flexible material such as, for example, an aluminum laminate film comprising aluminum foil sandwiched between two films, wherein a nylon film is the outer film and a polyethylene film is the inner film for enhancing a gas barrier property.

In the example shown in the figures, two aluminum laminate films are put on each other and are jointed around their peripheries by a method of heat sealing, or the like, whereby a bag main body portion 6 of the ink bag 3(1) is formed. An ink outlet part 7, for taking ink out of the ink bag in which it is stored, is attached to the front margin center of the bag main body portion 6 by a method of heat sealing, or the like.

The above-described ink bag 3(1) has its ink outlet part 7 fixed to the front part of the cartridge case 2, and its bag main body portion 6 fixed to the cartridge case 2 with a double-faced adhesive, or the like. The other ink bag 3(2) has its ink outlet part 7 fixed to the front part of the partition plate 4, and its bag main body portion 6 fixed to the partition plate 4 with a double-faced adhesive, or the like.

A detection plate 8 is fixed to the ink bag 3(1) by, for example, double-faced tape (not shown). The detection plate 8 is provided for detecting when the amount of ink remaining in the ink bag 3(1) decreases to a predetermined amount. A detection projection 9 is formed on the detection plate 8 so that it is capable of projecting to the outside from an opening 11 made in the bottom of the cartridge case 2. The amount of projection is increased with a decrease in the amount of ink remaining and, when the projection amount of the detection projection 9 becomes equal to or greater than a determined amount, the detection projection 9, is detected by an ink end detection mechanism (not shown) so that it is known when ink runs out.

Next, the cartridge case 2 will be described. The cartridge case 2 includes a case main body 12 open on its top (i.e., having opening 13) and a case lid 14 detachably covering the upper opening 13. The front 15 of the cartridge case 2 is formed with ink supply needle insertion holes 16 and 17, and a waste-ink collection needle insertion hole 18. The bottom of the cartridge case 2 is formed with the above-described opening 11. If the ink bag 3(1), 3(2) contained in the cartridge case 2 becomes empty of ink, the detection projection 9 projects from the opening 11 so that it can be, detected when the ink runs out. Three circular holes 19, 20, and 21, are made in the cartridge case front 15. The holes 19, 20, 21, are used for positioning the cartridge 1 when it is placed in a cartridge placement part formed in an ink jet printer, as described later.

In the cartridge case 2, in order from the bottom, the first ink bag 3(1), the partition plate 4, the second ink bag 3(2), and the waste-ink absorption material 5 are arranged in a case thickness direction 2V. See FIG. 3.

Next, the detailed structures of the parts of the ink cartridge 1 will be discussed. First, the case main body 12, which forms a part of the cartridge case 2, comprises a rectangular bottom plate portion 22 and a front wall portion 23, left and right side wall portions 24 and 25, and a rear wall portion 26, wherein the wall portions are formed as side plate portions rising upright from four peripheral margins of the bottom plate portion 22. Additionally, the case main body 12 has the opening 13 on its top. The opening 11, for detecting the detection projection, is made in the bottom plate portion 22. Further, an inclined part 27, which is inclined to the case top, is formed in the rear portion and is contiguous to the rear wall portion 26.

The front wall portion 23, the left and right side wall portions 24 and 25, and the rear wall portion 26, are formed on inner surfaces with a plurality of ribs 31, 32, 33, and 34. Upper end faces of the ribs (also called partition plate clamp faces) 31*a*, 32*a*,33*a*, and 34*a* are at the same height, thereby determining the position of the partition plate 4 in the cartridge case 2.

The case lid 14, which covers the upper opening 13 of the case main body 12, comprises a rectangular lid main body portion 35, an outer frame portion 36 formed in the four peripheral margins of the lid main body portion 35, and a rectangular inner frame portion 37 formed inside the outer frame portion 36. The outer frame portion 36 is formed on its outer surface with a step part 38 notched inside. The upper end parts of the front wall portion 23, the side wall portions 24 and 25, and the rear wall portion 26 of the case main body 12 are fitted into the step part 38 from the lower side. An end face 39 of the outer frame portion 36 functions as a partition plate clamp face for pressing the partition plate 4 against the rib upper end faces (also called partition plate clamp faces) 31*a*, 32*a*, 33*a*, and 34*a* formed in the case main body 12 from the upper side.

The inner frame portion 37 is taller than the outer frame portion 36, and the waste-ink absorption material 5 is housed inside the inner frame portion 37. Further, the waste-ink absorption material 5 is scaled in the inner frame portion 37 with a rectangular plastic film 41 put on the end face of the inner frame portion 37.

The joint structure of the case main body 12 and the case lid 14 will now be discussed. In this embodiment, the case lid 14 is detachably attached to the case main body 12 according to a snap-fit structure. That is, left and right insertion claws 43 and 44 are formed on, and are projected forward from, a front wall portion 42 of the outer frame portion 36 of the case lid 14. Insertion holes 45 and 46, into which the claws 43 and 44 can be inserted from the rear, are made in the upper end portion of the front wall portion 23 of the case main body 12.

On the other hand, as seen in FIG. 6, left and right side-wall portions 47 and 48 on the inner frame portion 37 of the case lid 14, are formed with engagement claws 49 and 50 of to snap-fit type, wherein the engagement claws 49 and 50 are projected outward. Engagement grooves 51 and 52, into which the engagement claws 49 and 50 can be fitted, arc formed at corresponding positions on the inner surfaces of the left and right side wall portions 24 and 25 of the case main body 12.

If the claws 43 and 44, on the front of the case lid 14, are inserted into the insertion holes 45 and 46 of the case main body 12, and then the rear portion of the case lid 14 is pushed into the opening 13 of the case main body 12 from the upper side, the left and right side wall portions 24 and 25 of the case main body 12 are elastically displaced and slightly widen so that the engagement claws 49 and 50 can be fitted into the engagement grooves 51 and 52. When the engagement claws 49 and 50 are fitted into the engagement grooves 51 and 52, the left and right side wall portions 24 and 25 arc elastically restored so that the case lid 14 is attached to the case main body 12.

To detach the case lid 14, a jig such as a screwdriver may be inserted into a gap G between the sidewall portion 24, 25 of the case main body 12 and the engagement claw 49, 50 so that the gap G may be forcibly widened for lifting up the case lid 14. See FIG. 6. In this embodiment, to easily detach the case lid 14, the gap G is made wider than that in the snap-fit structure in the related art, so that a screwdriver, etc., can be easily inserted into the gap G. Thus, in this embodiment, the case lid 14 can be easily detached so that the ink cartridge 1 can be easily disassembled when it is recycled, etc.

Next, the partition plate 4, which is housed in the cartridge case 2, comprises a rectangular main body portion 61 and a rectangular frame portion 62 rising upward from the four peripheral margins of the main body portion 61. The frame portion 62 is dimensioned for allowing the frame portion 62 to drop through the upper opening 13 and move along the inner surface of the case main body 12 in a slidable state. Upper end face portions 63, at the four corners of the frame portion 62, are at higher positions than other portions of the partition plate. The four corners of the frame portion 62 abut the outer frame end face (partition plate clamp face) 39 of the case lid 14 when the lid is attached to the case main body 12.

The main body portion 61 of the partition plate 4 is formed in its rear portion with an inclined part 64 which is inclined upward so that the rear end thereof is contiguous to the rear wall portion of the frame portion 62. The second ink bag 3(2) is mounted on the partition plate 4. The second ink bag 3(2) has its ink outlet 7 fixed to the outer frame front wall portion of the partition plate 4, and the rear face of its bag main body portion 6 is fixed to the surface of the main body portion 61 with a double-faced adhesive, or the like. The rear portion of the bag main body portion 6 is supported by the inclined part 64 formed in the rear portion of the main body portion 61 so that its position in the up and down direction of the case is defined.

Thus, if the partition plate 4 in this embodiment is dropped through the upper opening 13 and into the case main body 12, it abuts the rib upper end faces 31*a*, 32*a*, 33*a*, and 34*a* formed in the case main body 12 so that its position in the up and down direction in the case is defined. When the case lid 14 is attached to the case main body 12, the upper end face portions 63, at the four corners of the partition plate 4, are pressed downward by the end face 39 of the outer frame portion formed on the case lid 14.

Therefore, the partition plate 4 in this embodiment prevents the ink bags 3(1) and 3(2) from interfering with each other, and is sandwiched up and down between the case main body 12 and the case lid 14 so that it is held at a predetermined position in the case. Thus, the partition plate 4 easily can be detached from the case main body 12, unlike the case wherein the partition plate 4 is fixed to the case main body 12 with a joint structure of the snap-fit type. Consequently, the ink cartridge 1 of this embodiment can be assembled and disassembled extremely easily and, particularly, the partition plate can be attached and detached extremely easily.

Next will be discussed a positioning structure for fixing each ink outlet part 7, of the ink bag 3(1), 3(2) in this embodiment, to a predetermined position.

The ink outlet part 7 is, for example, a plastic molded article and includes a cylindrical ink derivation tube portion 71, a cylindrical opening tube portion 72, and a columnar outlet elastic body 73. The cylindrical ink derivation tube portion 71 is for deriving ink from the ink bag. The cylindrical opening tube portion 72 is of a large diameter and is formed at the tip of the ink derivation tube portion 71. Further, the columnar outlet elastic body 73 is made of an elastic material such as rubber, or the like, and is fitted into the opening tube portion 72 so that ink is sealed within the ink bag by the columnar outlet elastic body 73. The opening tube portion 72 has formed on its outer peripheral surface, an annular groove 74 that is rectangular in cross section.

In the case of main body 12, an ink outlet placement part 75 is formed at the center in the width direction of the front wall portion 23. Referring to FIGS. 3, 5, and 7, the ink outlet placement part 75 includes a projection wall portion 76 projected like a half circle, and also includes an ink supply needle insertion hole 16 made in the center of the projection wall portion 76. A positioning plate 78, formed with a semi-circular positioning groove 77 opened upward, is formed on the rear of the projection wall portion 76. If the ink bag's opening tube portion 72 is inserted into the ink outlet placement part 75 from the upper side, the positioning groove inner peripheral margin portion (also called an ink outlet clamp face) of the positioning plate 78 is fitted into the annular groove 74, whereby the ink bags ink outlet part 7 is fixed to the case main body 12.

An ink outlet placement part 80, having a similar structure to that of the ink outlet placement part 75, is formed at the center in the width direction of a front wall portion 79 of the partition plate 4. The ink outlet placement part 80 includes a projection wall portion 81 forwardly projected like a rectangle, and also includes an ink supply needle insertion hole 17 made in the center of the projection wall portion 81. A positioning plate 83, formed with a semi-circular positioning groove 82 opened upward, is formed on the rear of the projection wall portion 81. If the ink bag's opening tube portion 72 is inserted into the ink outlet placement part 80 from the upper side, the positioning groove inner peripheral margin portion of the positioning plate 83 is fitted into the annular groove 74, whereby the ink bags ink outlet part 7 is fixed to the partition plate 4.

As seen in FIGS. 3 and 7, in this embodiment, the ink outlet parts 7 and 7 of the ink bags 3(1) and 3(2) are overlaid on each other so that they are in direct contact with each other in the case thickness direction. Also, and the width of a center portion 83*a*, formed on the partition plate 4 (that is, its dimension in the up and down direction of the case) is determined so that the center portion 83*a* is just housed in the annular grooves 74 and 74 formed in the outer peripheral surfaces of the opening tube portions 72 and 72 of the ink outlet parts 7 and 7.

Next, vertical guide grooves 84 and 85 are formed in the partition plate 4 so that they are located on both sides of the projection wall portion 76. Additionally, in the front wall portion of the case main body 12, vertical guide rails 87 and 88 are formed in vertical margin portions on both sides of an opening 86 made above the ink outlet placement part 75. If the vertical guide rails 87 and 88 are inserted into the vertical guide grooves 84 and 85 in the partition plate 4 and, in this state, the partition plate 4 is dropped into the case main body 12, the ink outlet part 7 of the second ink bag 3(2) mounted on the partition plate 4 is positioned just above the ink outlet part 7 of the first ink bag 3(1) mounted on the bottom plate portion 22 of the case main body 12 so that the outer peripheral surfaces of the opening tube portions 72 and 72 abut each other. At the same time, the center portion 83*a* is sandwiched up and down between the annular grooves 74 and 74 formed in the outer peripheral surfaces of the opening tube portions 72 and 72.

Next, an ink outlet press part 91 is formed in the front center portion of the case lid 14. The ink outlet press part 91 includes left and right vertical frames 92 and 93, and a horizontal frame 94 for joining the lower ends of the vertical frames 92 and 93. The horizontal frame 94 is formed at the center of its lower face with a circular arc face 95 that matches the outer peripheral surface of the opening tube portion 72 of the ink outlet. Also, the circular arc face 95 is formed at its center with a projection that is slightly projected downward. Since the horizontal frame portion 94 is formed with the circular arc face 95 having a thin thickness, it is low in rigidity as compared with other portions and, therefore, easily becomes elastically deformed in the up and down direction so that it can function as a plate spring. A cylindrical waste-ink introduction tube 96, for introducing wasted ink into the waste-ink absorption material 5, is placed at the depth of the ink outlet press part 91 and is also formed of an elastic material, such as rubber, or the like. Further, a waste-ink collection needle is inserted into the waste-ink introduction tube 96.

The ink outlet press part 91 can also be inserted into the upper opening 13 of the case main body 12 from the upper side. When the ink outlet press part 91 is completely inserted into the upper opening 13, it presses the outer peripheral surface of the opening tube portion 72 of the second ink bag 3(2) with its circular arc face 95 of the horizontal frame 94.

Thus, in this embodiment, the ink outlet parts 7 and 7 are stacked up and down on each other without intervention of the partition plate 4. Therefore, the thickness of the ink cartridge 1 can be reduced by as much as the thickness of the partition plate as compared with the case where the partition plate intervenes between ink outlet parts. Generally, in the ink bag 3(1), 3(2), the outer diameter dimension of the opening tube portion 72 of the ink outlet part 7 is larger than the thickness of the bag main body portion 6 (when the bag main body portion is filled with ink) and, thus, the thickness of the ink bag housing portion depends on the thickness (outer diameter dimension) of the ink outlet part 7. If the partition plate 4 is sandwiched between the ink outlet parts 7 and 7, the thickness of the ink-bag housing portion is increased by as much as the thickness of the partition plate 4. In the embodiment, however, the ink outlet parts 7 and 7 are stacked up and down on each other with the opening tube portions 72 brought into direct contact with the ink outlet parts 7, so that the ink cartridge can be minimized and particularly the thickness dimension of the ink cartridge can be reduced.

In this embodiment, the case lid 14—formed with the ink outlet press part 91 having the circular arc face 95—presses the ink outlet parts 7 and 7 so that they are stacked up and down on each other against the bottom plate portion of the case main body 12 from the upper side. Therefore, the ink outlet parts 7 and 7 can be reliably fixed to predetermined positions.

Further, in this embodiment, the horizontal frame portion 94 in the ink outlet press part 91 is provided with a spring property so that the ink outlet parts 7 and 7 can be reliably fixed to the predetermined positions without involving looseness, and the like.

For example, red ink may be stored in the ink bag 3(1) and black ink may be stored in the ink bag 3(2). To use the ink cartridge of this embodiment with an ink jet recorder, as described later, usually black ink is used for printing and the portion to be highlighted is printed in red ink, whereby it is made possible to print in a lively style. For example, when the balance becomes minus, the bankbook is printed in red ink, whereby the bankbook owner can be warned of the balance due.

Alternatively, it is possible to store dark black ink and light black ink in the inkbags 3(1) and 3(2), respectively, in order to print a halftone like a photo, whereby smooth printing with less granular feeling can be executed on the ink jet printer.

Detection Plate

Figure 8:
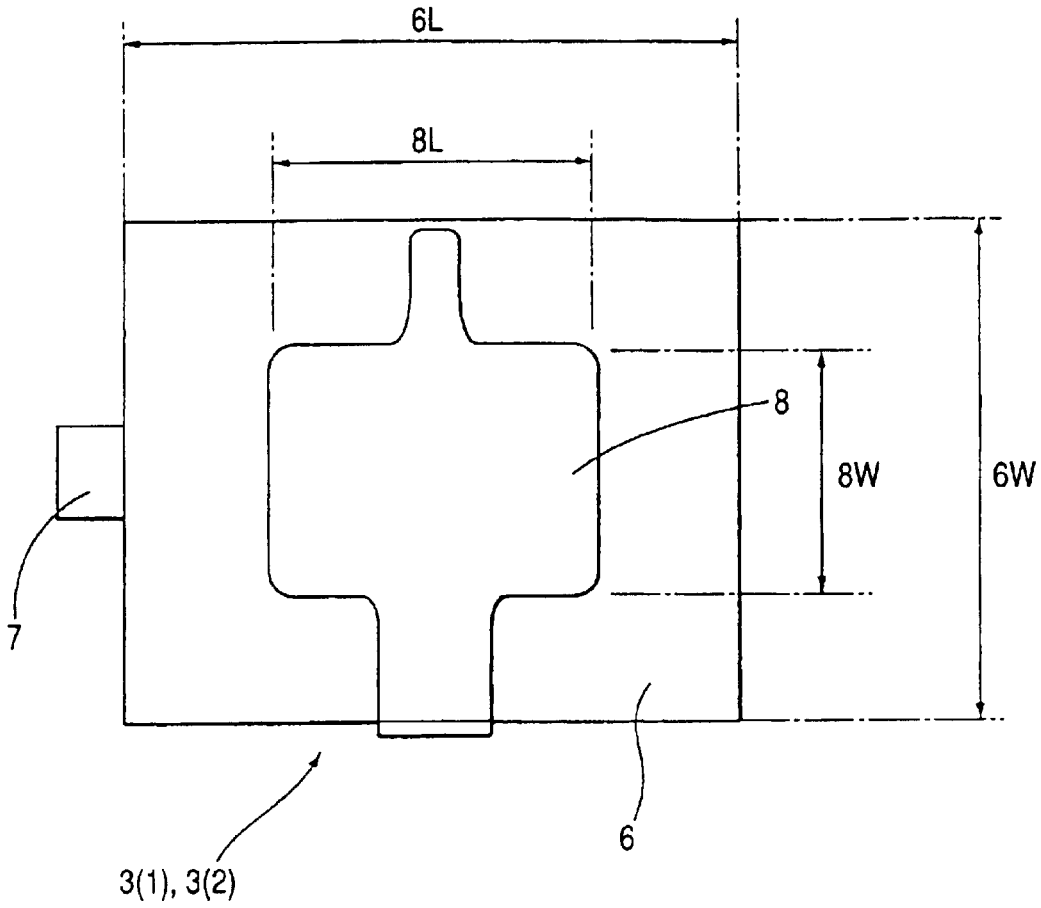
FIG. 8 is a schematic representation to describe the relationship between the contour shapes of an ink bag and a detection plate in the ink cartridge in FIG. 1.

Next, the contour shape of the detection plate 8, which is attached to the ink bag 3(1), 3(2), will be discussed with reference to FIG. 8. The contour shape of the detection plate 8 is set so as to reduce the amount of useless ink remaining accumulated in the peripheral portions of the bag main body portion 6, which portions are not covered by the detection plate 8. Movement of the detection plate 8, as the ink bag 3(1), 3(2) becomes deformed, is smooth so that variations in the amount of ink remaining after the detection plate indicates the end can be suppressed and the amount itself can be reduced.

The detection plate 8 is almost rectangular and is fixed to the bag main body portion 6 of the ink bag 3(1), 3(2), which is also rectangular, so that their sides become almost parallel with each other as shown in the figure.

According to the experiment of the inventors, it has been shown that it is desirable to place lateral dimension 8W of the detection plate 8 within 0.5 to 1.0 times lateral dimension 6W of the bag main body portion 6, particularly within the range of 0.7 to 1.0 times the lateral dimension 6W. Likewise, it has been shown that it is desirable to place longitudinal dimension 8L of the detection plate 8 within 0.4 to 0.8 times longitudinal dimension 6L of the bag main body portion 6, particularly within the range of 0.6 to 0.8 times the longitudinal dimension 6L.

In addition, to make the detection plate 8 easily follow deformation of the bag main body portion 6 of the ink bag—namely, deformation with a decrease in the amount of ink—for detecting the ink end with good accuracy, it is desirable to:

Place the ratio between: (i) the ratio between the lateral dimension 8W of the detection plate 8 and the lateral dimension 6W of the bag main body portion 6 (8W/6W); and (ii) the ratio between the longitudinal dimension 8L of the detection plate 8 and the longitudinal dimension 6L of the bag main body portion 6 (8L/6L), within the range of 0.8 to 1.2, particularly within the range of 0.9 to 1.1. In other words, it is desirable to make the contour shape of the detection plate 8 similar to the contour shape of the bag main body portion 6.

Further, to make the detection plate 8 easily follow deformation of the bag main body portion 6 of the ink bag—namely, deformation with a decrease in the amount of ink—for detecting the ink end with good accuracy, it is also desirable to set the thickness of the detection plate 8 within the range of 0.7 mm to 1.2 mm, particularly within the range of 0.8 mm to 1.0 mm.

The above-described ink cartridge 1 includes waste-ink absorption material, but the invention can also be applied to an ink cartridge having no waste-ink absorption material.

The above-described ink cartridge 1 includes detection plates 8, but the invention can also be applied to an ink cartridge having no detection plate.

Second Embodiment—an Ink Cartridge having a Partition Plate

The above-described ink cartridge 1, having a partition plate, comprises two ink bags and one partition plate placed therebetween. However, of course the invention can also be applied to an ink cartridge comprising three or more ink bags and partition plates each placed between two ink bags.

Figure 9:
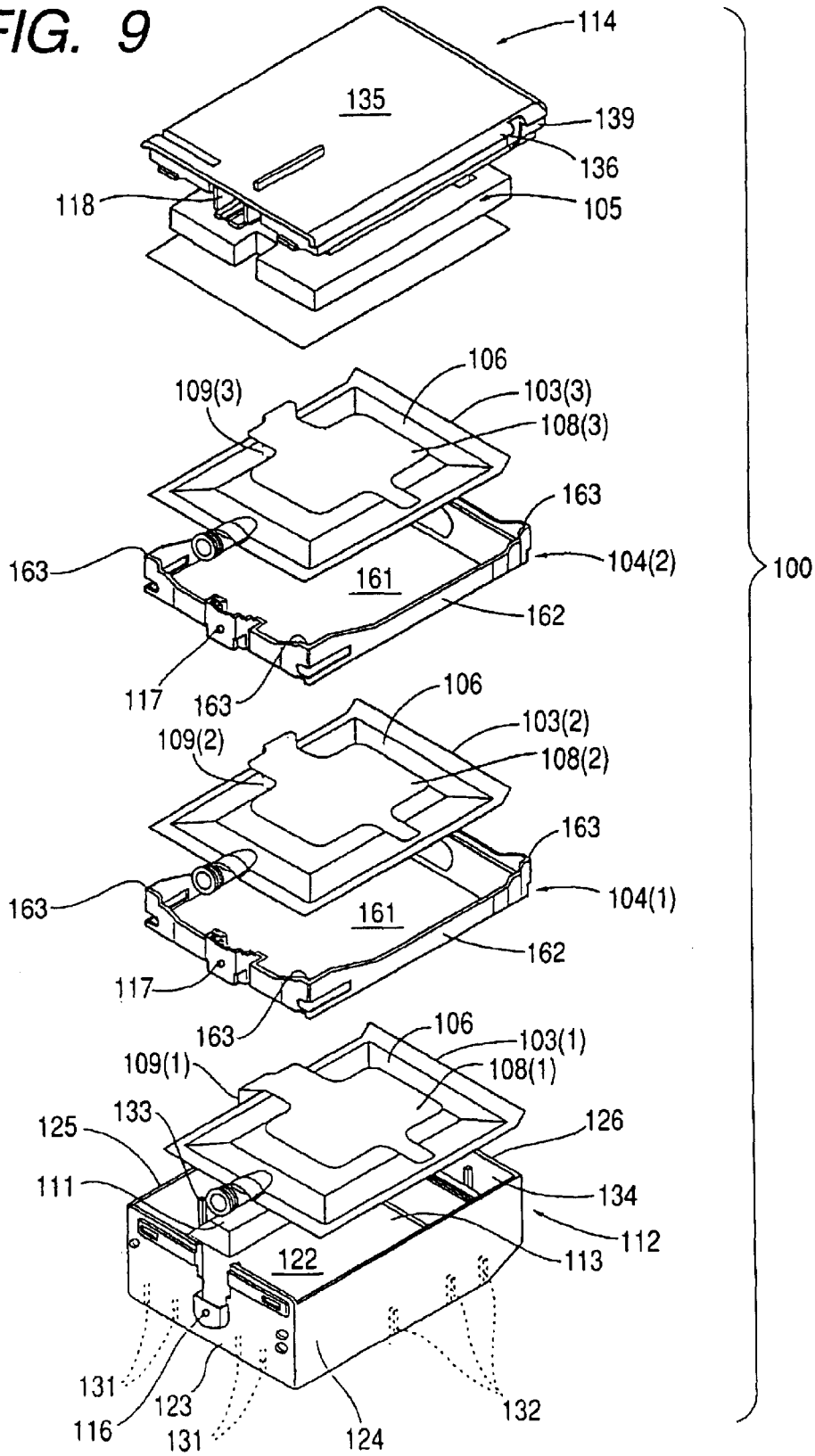
FIG. 9 is an exploded perspective view showing a second embodiment of an ink cartridge with a partition plate of the invention.
Figure 10:
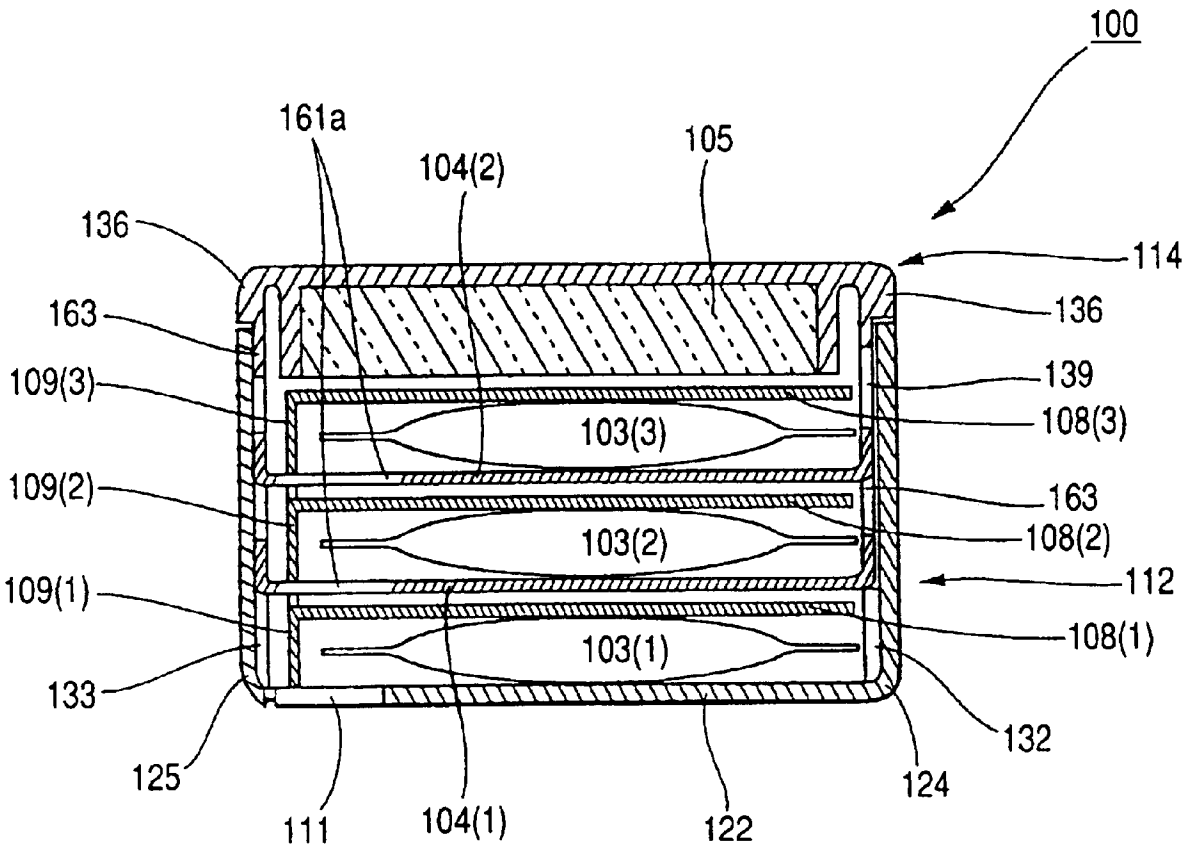
FIG. 10 is a transverse sectional view of the ink cartridge in FIG. 9.

FIGS. 9 and 10, respectively, are an exploded perspective view and a transverse sectional view showing a second embodiment of an ink cartridge comprising three ink bags and two partition plates each for partitioning the ink bags.

As shown in the figures, an ink cartridge 100 has a case main body 112, first, second, and third ink bags 103(1), 103(2), and 103(3) housed in the case main body 112, two partition plates 104(1) and 104(2) each placed between two ink bags, a waste-ink absorption material 105, and a case lid 114.

The case main body 112 and the case lid 114 are joined according to a snap fit structure as described above in connection with the ink cartridge 1; the case lid 114 is thus detachably attached to the case main body 112. The case lid 114 is easily detached so that the ink cartridge 100 can be easily disassembled when it is recycled, etc.

The ink bag 103(1), 103(2), 103(3) has the same structure and configuration as the ink bag 3(1), 3(2) of the ink cartridge 1. Yellow ink may be stored in the ink bag 103(1), magenta ink may be stored in the ink bag 103(2), and cyan ink may be stored in the ink bag 103(3).

The case main body 112 includes a rectangular bottom plate portion 122, a front wall portion 123, two side-wall portions 124 and 125, and a rear wall portion 126. The wall portions are formed as side plate portions rising upward from four peripheral margins of the bottom plate portion 122. Further, the case main body 112 has an opening 113 on its top.

The front wall portion 123 is formed with an ink supply needle insertion hole 116 into which an ink supply needle (described later) is inserted. Likewise, the front portions of the partition plates 104(1) and 104(2) are also each formed with an ink supply needle insertion hole 117. Further, the front portion of the case lid 114 is formed with a waste ink collection needle insertion hole 118.

As with the ink cartridge 1, the ink bag 103(1) has an ink outlet portion fixed to the front wall portion 123 of the case main body 112, and also has a bag main body portion 106 fixed to the bottom plate portion 122 of the case main body 112 with a double-faced adhesive, or the like, (not shown). The ink bag 103(2) has an ink outlet portion fixed to the front portion of the partition plate 104(1), and also has a bag main body portion 106 fixed to a bottom plate portion 161 of the partition plate 104(1) with a double-faced adhesive, or the like, (not shown). Similarly, the ink bag 103(3) has an ink outlet portion fixed to the front portion of the partition plate 104(2), and also has a bag main body portion 106 fixed to a bottom plate portion 161 of the partition plate 104(2) with a double-faced adhesive, or the like, (not shown).

The front wall portion 123, the left and right side wall portions 124 and 125, and the rear wall portion 126, have formed, on their inner surfaces, a plurality of ribs 131, 132, 133, and 134. The upper ends of the ribs (also called partition plate clamp faces) are at the same height, thereby determining the position of the partition plate 104(1) in the ink cartridge 100.

The case lid 114 includes a rectangular lid main body portion 135, and an outer frame portion 136 formed in the four peripheral margins of the lid main body portion 135. An end face 139, of the outer frame portion 136, functions as a partition plate clamp face for pressing the partition plate 104(1), 104(2) against the rib upper ends (also called partition plate clamp faces) formed in the case main body 112.

Each of the partition plates 104(1) and 104(2) housed in the case main body 112 comprises the above-mentioned bottom plate portion 161 and a rectangular frame portion 162 rising upward from the four peripheral margins of the bottom plate portion 161. The frame portion 162 is dimensioned to allow the frame portion 162 to drop through the opening 113 of the case main body 112 and along the inner surface thereof in a slidable state. Upper end face portions 163, at the four corners of the frame portion 162, are at higher positions than are other portions of the frame portion. Also, the end face portions 163 abut the outer frame end face (partition plate clamp face) 139 of the case lid 114 when it is attached to the case main body 112.

Thus, if the first partition plate 104(1) in this embodiment is dropped through the upper opening 113 and into the case main body 112, it abuts the upper end faces of ribs 131, 132, 133, and 134 formed in the case main body 112, and its position in the up and down direction in the case is defined. Next, if the second partition plate 104(2) is dropped through the upper opening 113 and into the case main body 112, it abuts the upper end face portions 163 at the four corners of the first partition plate 104(1), and its position in the up and down direction in the case is defined. Further, if the case lid 114 is then attached to the case main body 112, the upper end face portions 163 at the four corners in the frame portion 162 of the second partition plate 104(2) are pressed downward by the end face 139 of the outer frame portion 136 formed on the case lid 114.

Therefore, the first and second partition plates 104(1) and 104(2) in this embodiment are sandwiched up and down between the case main body 112 and the case lid 114 so that they are held at predetermined height positions in the case. Thus, the partition plates 104(1) and 104(2) can be easily detached from the case main body 112, unlike the case where the partition plates 104(1) and 104(2) are fixed to the case main body 112 by a joint structure of the snap fit type. Consequently, the ink cartridge 100 of this embodiment can also be assembled and disassembled extremely easily and, particularly, the partition plates can be attached and detached extremely easily.

A detection plate 108(1) is fixed to the ink bag 103(1) by, for example, double-faced tape (not shown). The detection plate 108(1) is provided for detecting when the amount of ink remaining in the ink bag 103(1) has decreased to a predetermined amount. A detection projection 109(1) is formed on the detection plate 108(1) so that it is capable of projecting to the outside from an opening 111 made in the bottom plate portion 122 of the case main body 112. The amount of projection is increased with a decrease in the amount of ink remaining and, when the projection length of the detection projection 109(1) becomes equal to or greater than a determined length, the detection projection 109(1) is detected by an ink end detection mechanism (described later) so that it is known when the yellow ink runs out.

A detection plate 108(2) is fixed to the ink bag 103(2). The detection plate 108(2) is also provided for detecting when the amount of ink remaining in the ink bag 103(2) decreases to a predetermined amount. A detection projection 109(2) is formed on the detection plate 108(2) so that it is capable of passing through an opening 161*a* made in the bottom plate portion 161 of the partition plate 104(1), and so that a tip thereof is capable of being placed in the space formed by: the bottom plate portion 122; the front wall portion 123; the left and right side wall portions 124 and 125; and the rear wall portion 126; and the bottom plate portion 161 of the partition plate 104(1). The detection projection 109(2) is capable of projecting to the outside from the opening 111, which is made in the bottom plate portion 122 of the case main body 112, in such a manner that the amount of projection is increased with a decrease in the amount of ink remaining. When the projection length of the detection projection 109(2) becomes equal to or greater than a determined length, the detection projection 109(2) is detected by the ink end detection mechanism and it is known that magenta ink has run out.

Likewise, a detection plate 108(3) is fixed to the ink bag 103(3). The detection plate 108(3) is also provided for detecting when the amount of ink remaining in the ink bag 103(3) decreases to a predetermined amount. A detection projection 109(3) is formed on the detection plate 108(3) so that it is capable of passing through an opening 161*a* made in the bottom plate portion 161 of the partition plate 104(1) and an opening 161*a* made in the bottom plate portion 161 of the partition plate 104(2), and so that a tip thereof is capable of being placed in the space formed by; the bottom plate portion 122; the front wall portion 123; the left and right side wall portions 124 and 125; the rear wall portion 126 of the case main body 112; and the bottom plate portion 161 of the partition plate 104(1). The detection projection 109(3)projects to the outside from the opening 111, which is made in the bottom plate portion 122 of the case main body 112, in such a manner that the amount of projection is increased with a decrease in the amount of ink remaining. When the projection length of the detection projection 109(3) becomes equal to or greater than a determined length, the detection projection 109(3) is detected by the ink end detection mechanism (described later) and it is known that cyan ink has run out.

As described above, the first and second partition plates 104(1) and 104(2) in this embodiment are sandwiched up and down between the upper end faces of the ribs 131, 132, 133, and 134 (also called partition plate clamp faces) formed in the case main body 112, and the outer frame end face (also called the partition plate clamp face) 139 of the case lid 114 so that they are held at predetermined positions in the case. Thus, the up and down positions of the partition plates 104(1) and 104(2) in the case are defined, and the up and down positions of the second and third ink bags 103(2) and 103(3)—which are held on the partition plates 104(1) and 104(2)—can also be defined with good accuracy. Further, the projection accuracy of the detection projections 109(2) and 109(3), of the detection plates attached to the ink bags, is enhanced so that the amount of ink remaining in each of the second and third ink bags 103(2) and 103(3) can be detected with good accuracy. That is, the ends of magenta ink and cyan ink can be detected with the same level of accuracy as is detected the end of yellow ink.

The above-described ink cartridge 100 includes waste-ink absorption material but, of course, the invention can also be applied to an ink cartridge having no waste-ink absorption material.

Figure 11:
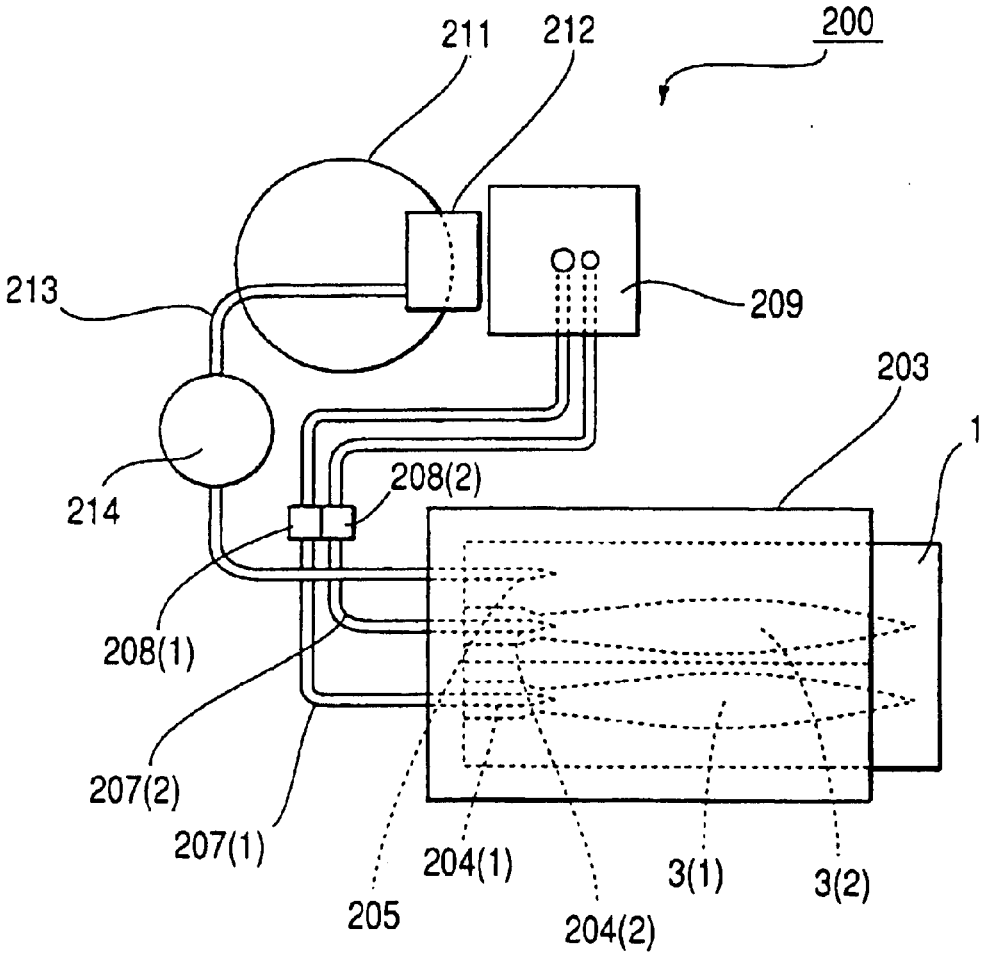
FIG. 11 is a schematic configuration drawing showing ink supply and discharge channels of an ink jet printer in which the ink cartridge in FIG. 1 is placed.

Third Embodiment—Ink Jet Printer using an Ink Cartridge 1 as an Ink Supply Source An embodiment of an ink jet printer using the above-described ink cartridge 1, having a partition plate, as an ink supply source will be discussed with reference to FIGS. 11, 12, and 13.

First, ink supply and discharge channels of an ink jet printer 200 of this embodiment will be discussed with reference to FIG. 11. The basic configuration of the ink jet printer 200 is similar to that of a generally used ink jet printer and, therefore, will not be discussed here. The ink jet printer 200 is formed with a cartridge placement section 203 in which the ink cartridge 1 detachably is placed. Two ink supply needles 204(1) and 204(2), and one waste ink collection needle 205, are attached to the cartridge placement section 203, for example, horizontally. If the needles 204(1), 204(2), and 205 respectively are inserted into the ink supply needle insertion holes 16 and 17 and the waste ink collection needle insertion hole 18 in the ink cartridge 1, ink flow passages for supplying and discharging ink are formed between the ink cartridge 1 and the ink jet printer 200.

When the ink flow passages are formed, ink stored in the cartridge's ink bag 3(1) and ink in the ink bag 3(2) are taken out into ink supply tubes 207(1) and 207(2) through the ink supply needles 204(1) and 204(2). Filters 208(1) and 208(2), for filtering dust and foreign substance in the ink, are placed at midpoints of the ink supply tubes 207(1) and 207(2).

Ink is introduced into an ink jet head 209, of the ink jet printer 200, through the ink supply tubes 207(1) and 207(2). The ink jet head 209 is mounted on a carriage (not shown) and is reciprocated in the length direction along the surface of a platen 211. Record paper (not shown) is transported in a direction orthogonal to the move direction of the ink jet head 209 along the surface of the platen 211, and is printed with the ink jet head 209.

To maintain the print quality of the ink jet head 209, ink nozzles of the ink jet head 209 are cleaned by sucking ink therefrom. For this purpose, a head cap 212 is placed at a position out of a print area of the ink jet head 209, and the ink jet head 209 periodically is moved to the position of the head cap 212. A waste ink tube 213, for collecting waste ink collected or sucked from the ink jet head 209 by way of the head cap 212, is connected to the head cap 212. A waste ink pump 214, as a drive source for collecting waste ink, is connected to the waste ink tube 213.

The waste ink passes through the waste ink tube 213, by action of the waste ink pump 214, and then passes through the waste ink collection needle 205 so that it enters the cartridge. Thus, waste ink is collected and held in the waste-ink absorption material 5, which is in the cartridge.

Figure 12:
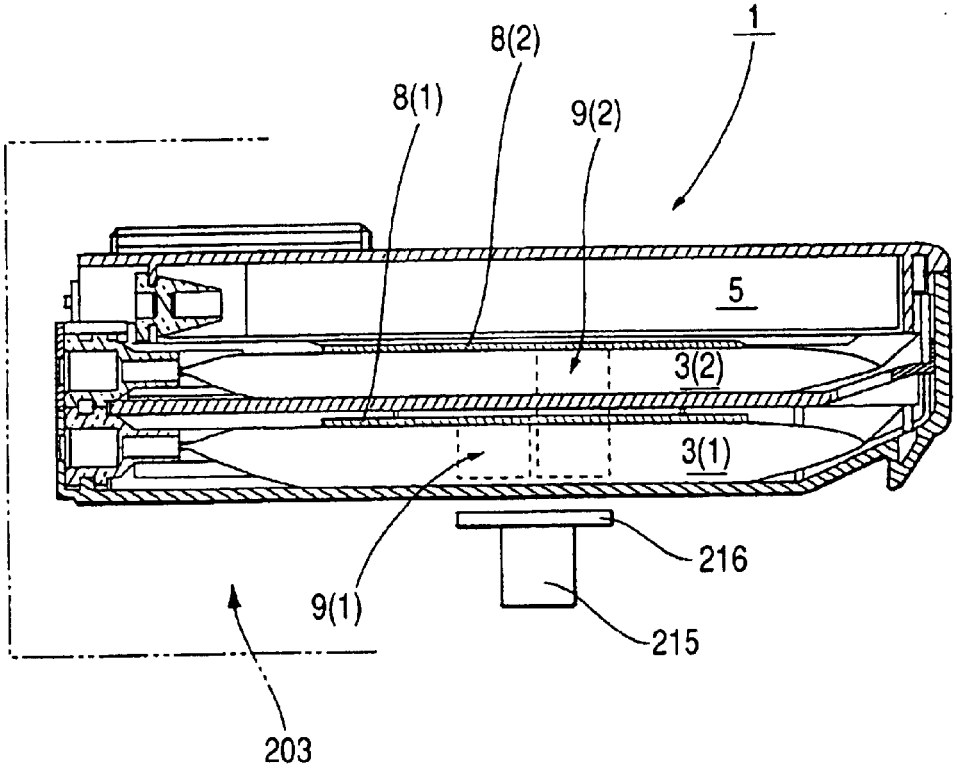
FIG. 12 is a schematic representation showing an ink end detection mechanism attached to an ink cartridge placement section in FIG. 11.
Figure 13:
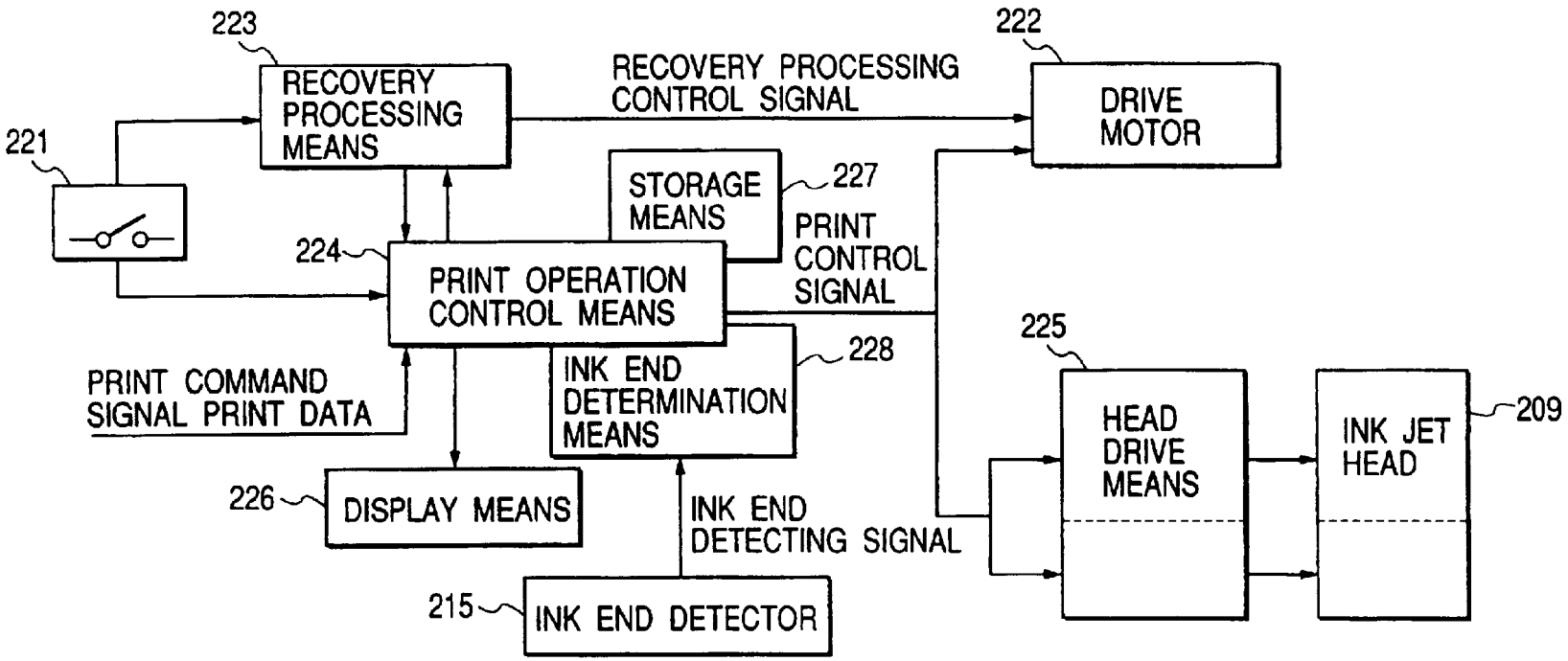
FIG. 13 is a schematic block diagram showing a control system of the ink jet printer in FIG. 11.

FIG. 12 is a schematic representation to describe an ink end detection mechanism contained in the ink jet printer 200 of this embodiment. As shown in the figure, an ink end detector 215 is installed in the cartridge placement section 203, and a transfer plate 216 is fixed to the ink end detector 215 with an adhesive, or the like. If the remaining amount of red ink in the ink bag 3(1) is decreased to a predetermined amount, or if the remaining amount of black ink in the ink bag 3(2) is decreased to a predetermined amount, the detection projection 9(1) formed on the detection plate 8(1) or the detection projection 9(2) formed on the detection plate 8(2) presses the transfer plate 216 thereby turning on the ink end detector 215. The transfer plate 216 is a thin plate having rigidity; here, an acrylic plate 1 mm thick is used. The ink end detector 215 is a switch of the mechanical contact type.

Next will be described FIG. 13, which is a schematic block diagram showing a control system of the ink jet printer 200 of this embodiment. In the figure, reference numeral 221 denotes a power switch for making the printer operational, and as an example of power supply, a DC regulator is connected to an AC power supply as a drive source. Numeral 209 denotes the above-described ink jet head, numeral 215 denotes the above-described ink end detector, and numeral 222 denotes a drive motor having capabilities of moving the carriage on which the ink jet head 209 is mounted, transporting record paper, and driving the waste ink pump 214. Numeral 223 denotes recovery processing means for driving the drive motor 222, and for controlling the cleaning of the ink jet head 209 and the sucking of ink. Separate drive motors for moving the carriage, transporting record paper, and driving the waste ink pump may be provided as the drive motor 222.

Numeral 224 denotes print operation control means for expanding print data from an external instruction system, such as a personal computer, into a printer language. The print operation control means is also for controlling head drive means 225 and the drive motor 222 with a print control signal, based on a print command signal, for executing print control. Further, the print operation control means 224 controls the recovery processing means 223 and display means 226. Numeral 227 denotes storage means, used by the print operation control means 224 to perform operation processing, and the like, for temporarily storing the print data and the provided print language.

The ink jet head 209 of this embodiment is divided into a portion for jetting red ink supplied from the ink bag 3(1) of the ink cartridge 1, and a portion for jetting black ink supplied from the ink bag 3(2). To jet ink in a liquid drop state from the nozzles of the ink jet head 209 for printing record paper, the ink jet head drive means 225 controls the driving of the ink jet head 209 for each portion based on the print control signal.

The display means 226 displays various pieces of information for the operator of the ink jet printer 200. Numeral 228 denotes ink end determination means for receiving a detection signal from the ink end detector 215, and for determining whether either ink in the ink cartridge 1 runs out.

If the remaining amount of red ink in the ink bag 3(1) is decreased to the predetermined amount, or if the remaining amount of black ink in the ink bag 3(2) is decreased to the predetermined amount, the ink end detector 215 is turned on, the ink end determination means 228 receives an ink end detection signal and determines that the ink has run out. The ink end determination means 228 transfers the determination result to the print operation control means 224, which then stops the operation of the head drive means 225 to stop printing and displays a message on the display means 226 that ink has run out.

Figure 14:
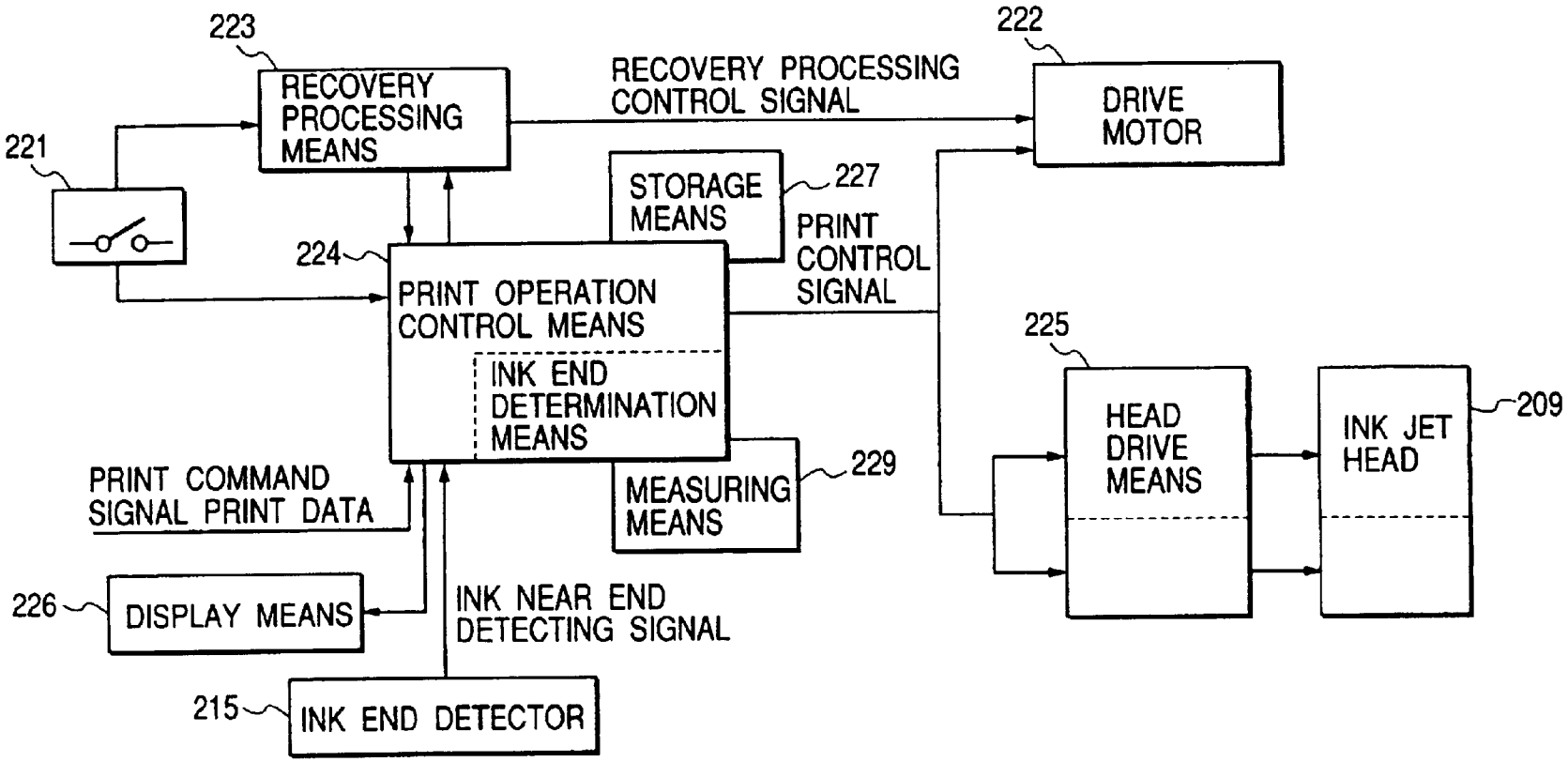
FIG. 14 is a schematic block diagram showing another example of the controller in FIG. 13.

Next, FIG. 14 is a schematic block diagram showing another exemplary configuration of the controller of the ink jet printer 200 of this embodiment. In the figure, ink jet head 209, ink end detector 215, recovery processing means 223, head drive means 225, drive motor 222, power switch 221, and display means 226 are, in operation and control method, identical with or similar to those previously described with reference to FIG. 13 and, therefore, will not be discussed again.

In the controller, numeral 229 denotes measuring means for measuring the amount of ink jetted from the ink jet head 209, and the amount of ink consumed as waste ink, based on a command from print operation control means 224. The amount of ink jetted from the ink jet head 209 is calculated from the number of times each nozzle has been driven by the head drive means 225, for example. The amount of ink consumed as waste ink is calculated from the number of times the waste ink pump 214 has been driven, for example.

The print operation control means 224 expands print data from an external instruction system, such as a personal computer, into a printer language and controls the head drive means 225 and the drive motor 222 with a print control signal based on a print command signal for executing print control. The print operation control means 224 controls the display means 226, and the measuring means 229, as well as the recovery processing means 223 and, thereby, determines the ink end.

Storage means 227 temporarily stores the print data, and the provided print language, when the print operation control means 224 performs operation processing, and the like. Also, the storage means 227 stores a predetermined ink amount and the ink amount measured by the measuring means 229.

If the remaining amount of red ink in the cartridges ink bag 3(1) is decreased to a predetermined amount, or if the remaining amount of black ink in the ink bag 3(2) is decreased to a predetermined amount, the ink end detector 215 is turned on and the print operation control means 224 receives an ink-near-end detection signal. Upon reception of the ink-near-end detection signal, the print operation control means 224 displays, on the display means 226, a message indicating that the ink is near end and instructs the measuring means 229 to measure the amount of ink jetted from the head 209 and the amount of ink consumed as waste ink. When a print command signal is input to control the recovery processing means 223, the print operation control means 224 checks the ink amount measured by the measuring means 229. When the power switch 221 is turned off, the print operation control means 224 temporarily stores, in the storage means 227, the ink amount measured by the measuring means 229. The predetermined ink amount is also stored in the storage means 227. Thus, if the print operation control means 224 determines that the ink amount measured by the measuring means 229 has reached the predetermined ink amount, it stops the operation of the head drive means 225 to stop printing, and displays a message on the display means 226 indicating that the ink has run out.

It is possible for the ink jet printer, having the above-described controller, to continue printing until the predetermined amount of ink as stored in the storage means 227 is used up, even after the message indicating that the ink is near its end is displayed on the display means 226. Meanwhile, the operator of the ink jet printer may have a new ink cartridge on hand. Thus, the ink jet printer provides excellent usability and is convenient for the operator of the printer.

In this case, after detecting that the ink is near its end, the remaining amount of ink can be displayed on the display means 226, for example. That is, the display means 226 will indicate the amount of ink remaining until the print operation control means 224 stops the operation of the head drive means 225 to stop printing when the amount of ink measured by the measuring means 229 reaches the predetermined amount of ink. This makes it furthermore convenient for the operator of the ink jet printer.

The ink jet printer 200 in which the small-sized ink cartridge 1, although no ink bags are housed therein, is placed can print in a plurality of inks and the ink jet printer itself can be miniaturized.

With an ink jet printer wherein one ink bag is housed in an ink cartridge and one ink cartridge is placed for each ink, the volume of a cartridge placement section of the ink jet printer grows. And when ink is used up, it is necessary to replace the ink cartridge for each ink so that the operator of the ink jet printer is inconvenienced. Further, the operator of the ink jet printer needs to have an ink cartridge on hand for each type of ink used.

In contrast, in the present invention, the volume of the cartridge placement section is reduced and, thus, the ink jet printer can also be miniaturized. Further, an ink cartridge needs to be replaced only once for a plurality of inks, so that the ink cartridge replacement frequency is low, and so that the replacement operation is easy. To print in a plurality of colors, the operator of the ink jet printer needs to have only one ink cartridge on hand; it is convenient for the operator. In addition, the ink jet printer of the present embodiment contains one ink end detector and, thus, can be miniaturized along with its cost being reduced.

Figure 15:
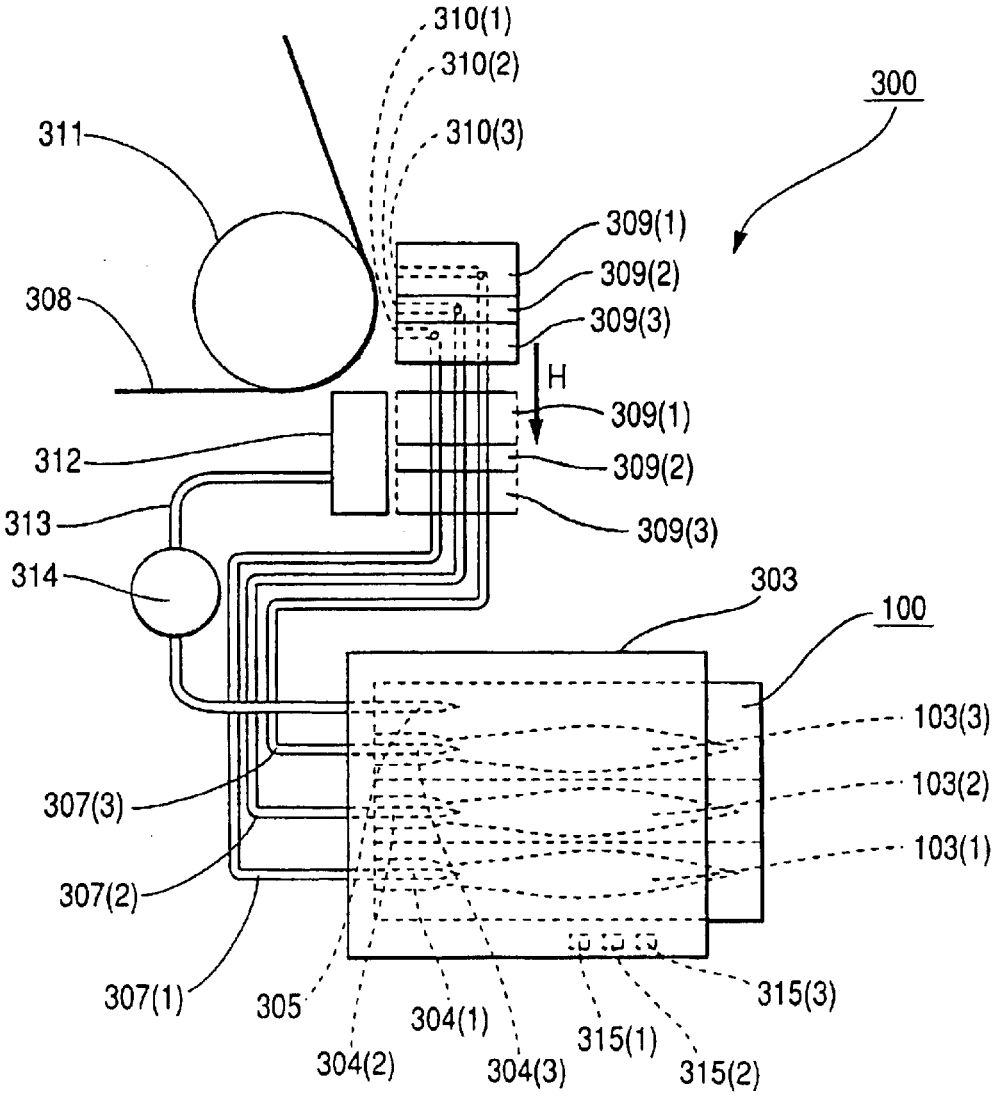
FIG. 15 is a schematic configuration drawing showing ink supply and discharge channels of an ink jet printer in which the ink cartridge in FIG. 9 can be placed.
Figure 16:
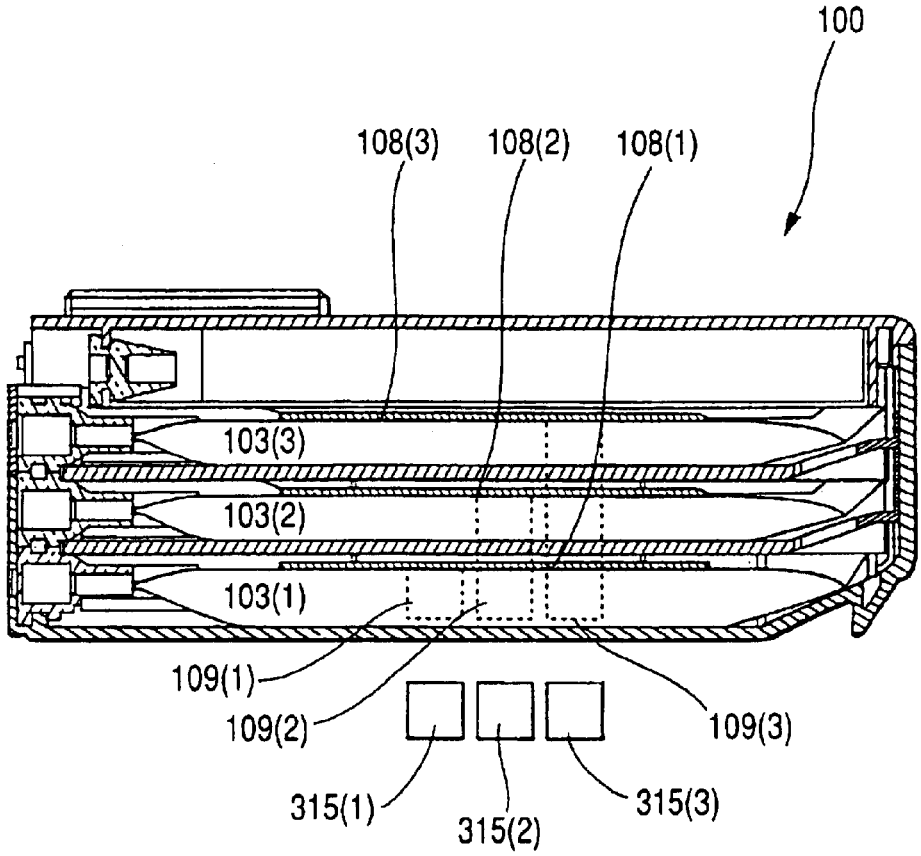
FIG. 16 is a schematic representation showing an ink end detection mechanism in the ink jet printer in FIG. 15.
Figure 17:
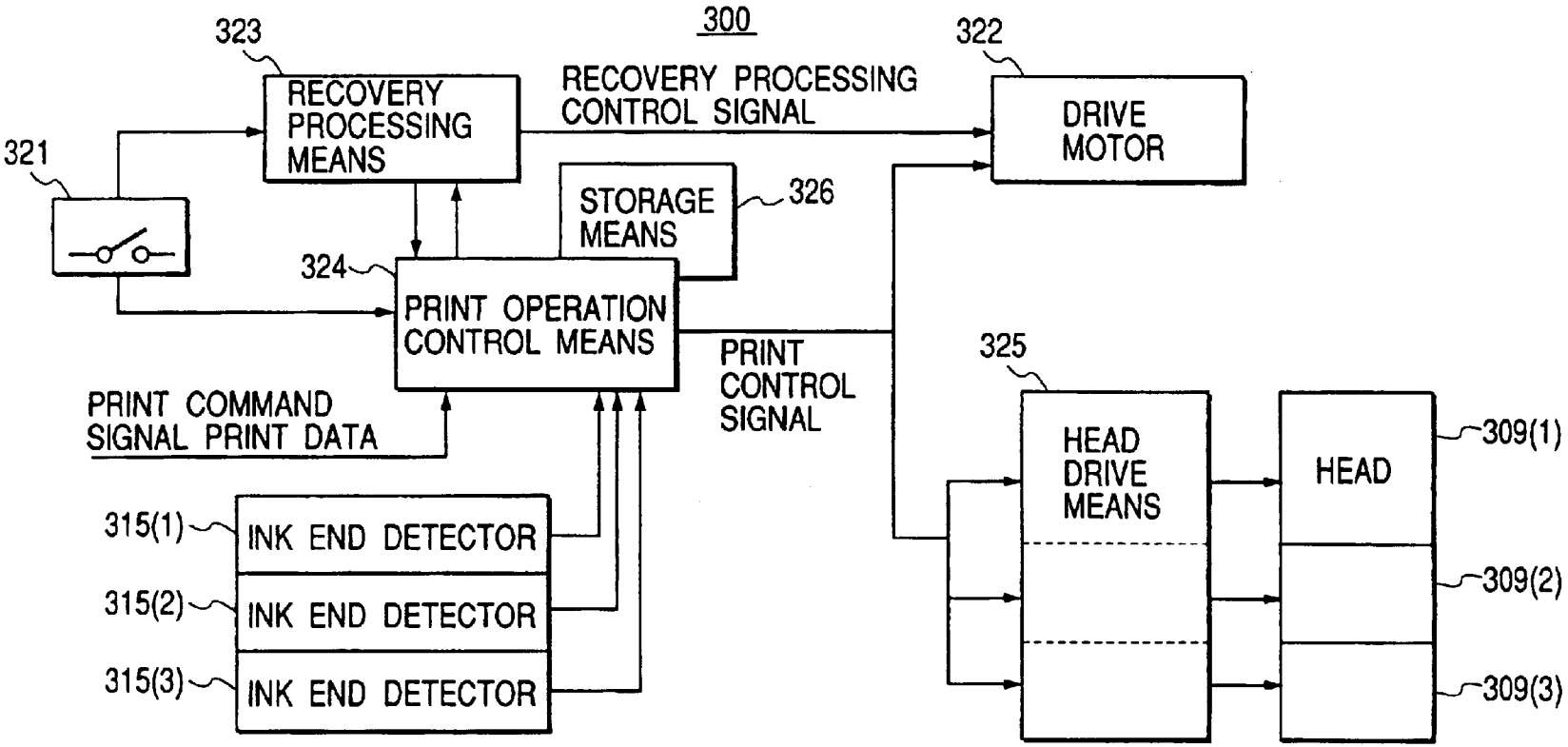
FIG. 17 is a schematic block diagram showing a control system of the ink jet printer in FIG. 15.

Fourth Embodiment—an Ink Jet Printer Using an Ink Cartridge 100 as an Ink Supply Source FIG. 15 is a schematic configuration drawing showing ink supply and discharge channels of an ink jet printer using the above-described ink cartridge 100, which has partition plates, as an ink supply source. FIG. 16 is a schematic representation to describe an ink end detection mechanism in the ink jet printer. FIG. 17 is a schematic block diagram showing a control system of the ink jet printer.

First, the configuration of an ink jet printer 300 of this embodiment and an ink end detection method will be discussed with reference to FIGS. 15 and 16. The ink jet printer 300 is formed with a cartridge placement section 303 in which the ink cartridge 100 detachably is placed. Three ink supply needles 304(1), 304(2), and 304(3) and one wastes ink collection needle 305 are attached to the cartridge placement section 203 so that they extend horizontally. If the ink supply needle 304(1) is inserted into the ink supply needle insertion hole 116, the ink supply needles 304(2) and 304(3) are inserted into the two ink supply needle insertion holes 117 and 117, and the waste ink collection needle 305 is inserted into the waste ink collection needle insertion hole 118, ink flow passages for supplying and discharging ink are formed between the ink cartridge 100 and the ink jet printer 300.

When the ink flow passages are formed, yellow ink, magenta ink, and cyan ink stored in the three ink bags 103(1), 103(2), and 103(3) are taken out into ink supply tubes 307(1), 307(2), and 307(3) through the ink supply needles 304(1), 304(2), and 304(3).

Yellow, magenta, and cyan inks are introduced into three ink jet heads 309(1), 309(2), and 309(3) of the ink jet printer 300 through the ink supply tubes 307(1), 307(2), and 307(3). Nozzle groups 310(1), 310(2), and 310(3) are placed in the heads 309(1), 309(2), and 309(3) in a direction orthogonal to the paper face and are filled with inks introduced from the ink supply tubes 307(1), 307(2), and 307(3). That is, the nozzle group 310(1) of the head 309(1) is filled with yellow ink, the nozzle group 310(2) of the head 309(2) is filled with magenta ink, and the nozzle group 310(3) of the head 309(3) is filled with cyan ink. Record paper 308 is transported in the arrangement direction of the three heads 309(1), 309(2), and 309(3) along the surface of a platen 311, and is printed with the heads 309(1), 309(2), and 309(3).

To maintain the print quality of the heads 309(1), 309(2), and 309(3), they are cleaned by sucking ink therefrom. A head cap 312 is placed below the platen 311, and the heads 309(1), 309(2), and 309(3) together are moved in the direction of arrow H to the position of the head cap 312. The head cap 312 abuts the three heads 309(1), 309(2), and 309(3) and sucks inks from the nozzle groups 310(1), 310(2), and 310(3) at the same time. A waste ink tube 313, for collecting waste ink collected or sucked from the heads 309(1), 309(2), and 309(3) by the head cap 312, is connected to the head cap 312. A waste ink pump 314, as a drive source for collecting waste ink, is connected to the waste ink tube 313.

The waste ink flows through the waste ink tube 313 by action of the waste ink pump 314. The waste ink then flows through the waste ink collection needle 305 and into the waste-ink absorption material 105, where it is collected and held.

Three ink end detectors 315(1), 315(2), and 315(3) are installed in the cartridge placement section 303. If the remaining amount of yellow ink in the ink bag 103(1) is decreased to a predetermined amount, the detection projection 109(1) formed on the detection plate 108(1) turns on the ink end detector 315(1). Likewise, if the remaining amount of magenta ink in the ink bag 103(2) is decreased to a predetermined amount, the detection projection 109(2) formed on the detection plate 108(2) turns on the ink end detector 315(2). And if the remaining amount of yellow ink in the ink bag 103(3) is decreased to a predetermined amount, the detection projection 109(3) formed on the detection plate 108(3) turns on the ink end detector 315(3). The ink end detector 315(1), 315(2), 315(3) may be of a mechanical contact type, or may be of light detection type such as a photo interrupter, or any other type as long as the ink end detector can detect the fact that the projection length of the detection projection 109(1), 109(2), 109(3) from the ink cartridge 100 becomes equal to or greater than a determined length.

Next, the control operation in the ink jet printer 300 will be discussed with reference to FIG. 17. Numeral 321 denotes a power switch for making the printer operational. Numerals 309(1), 309(2), and 309(3) denote the above-described ink jet heads, and numeral 322 denotes a drive motor capable of transporting the record paper 308 and driving the waste ink pump 314. Numeral 323 denotes recovery processing means for driving the drive motor 322, for controlling the cleaning of the heads 309(1), 309(2), and 309(3), and for controlling the sucking of ink. Separate drive motors for transporting record paper and driving the waste ink pump may be provided as the drive motor 322.

Numeral 324 denotes print operation control means for expanding print data from an external instruction system, such as a personal computer; into a printer language. The print operation control means is also for controlling the head drive means 325 and the drive motor 322 with a print control signal, based on a print command signal, for executing print control. Further, the print operation control means 324 receives a detection signal from the ink end detector 315(1), 315(2), or 315(3), and determines which colored ink in the ink cartridge 100 has run out. Numeral 326 denotes storage means, used by the print operation control means 324 to perform operation processing, and the like, for temporarily storing the print data and the provided print language.

To jet ink in a liquid drop state from the nozzles of the heads 309(1), 309(2), and 309(3), for printing record paper, the head drive means 325 controls the driving of the heads 309(1), 309(2), and 309(3) based on the print control signal. In this embodiment, the head drive means 325 is divided and the control signal can be transferred for each head so that the heads 309(1), 309(2), and 309(3) can be controlled separately.

For example, if yellow color print data and print command signal are input after the ink end detector 315(1) is turned on, and the print operation control means 324 determines that yellow ink has run out, the print operation control means 324 transfers a print control signal to the head drive means 325 so as to print in magenta ink or cyan ink, i.e., an ink that does not correspond to the detection signal received from the ink end detector. When one ink runs out, the print operation control means 324 determines which color to be used based on the data stored in the storage means 326.

The ink jet printer 300 is thus controlled, whereby all inks stored in the ink cartridge 100 can be used up, useless ink can be reduced, and the running costs of the ink jet printer 300 can be decreased.

Fifth Embodiment—A Split-type Ink Cartridge

Next, an ink cartridge of another configuration incorporating the present invention will be discussed. The ink cartridge described below is a split-type ink cartridge having a structure that can be split up and down.

Figure 18:
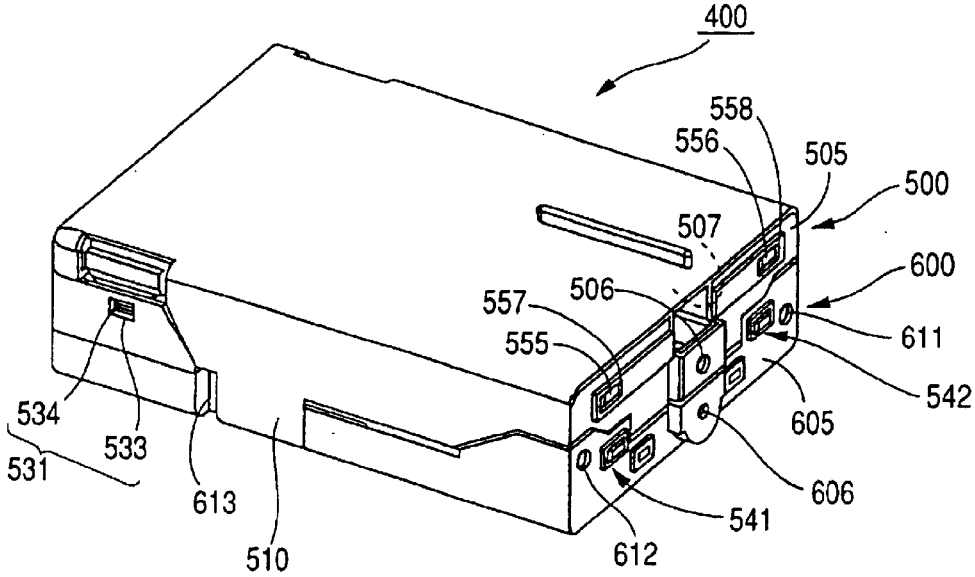
FIG. 18 is an external perspective view of a split-type ink cartridge of another embodiment of the invention when the ink cartridge is viewed from the top.
Figure 20:
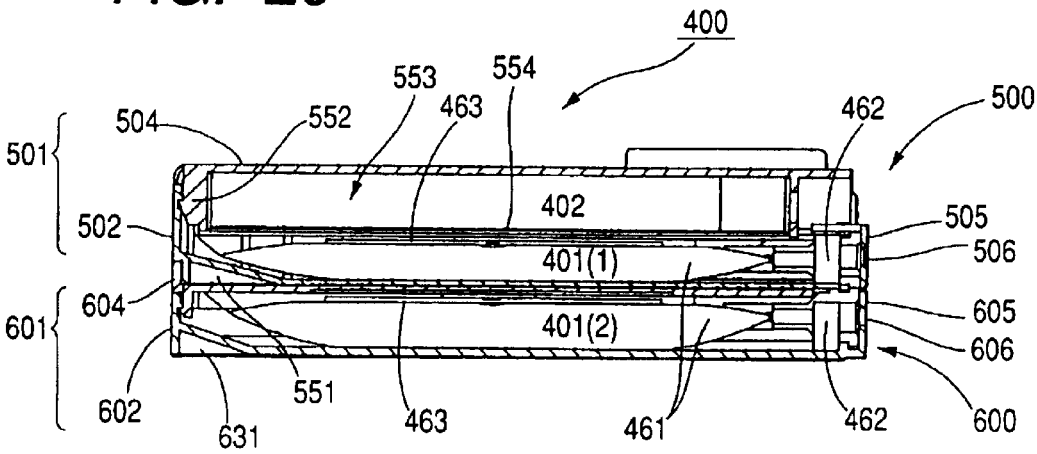
FIG. 20 is a longitudinal sectional view of the ink cartridge in FIG. 18.
Figure 19:
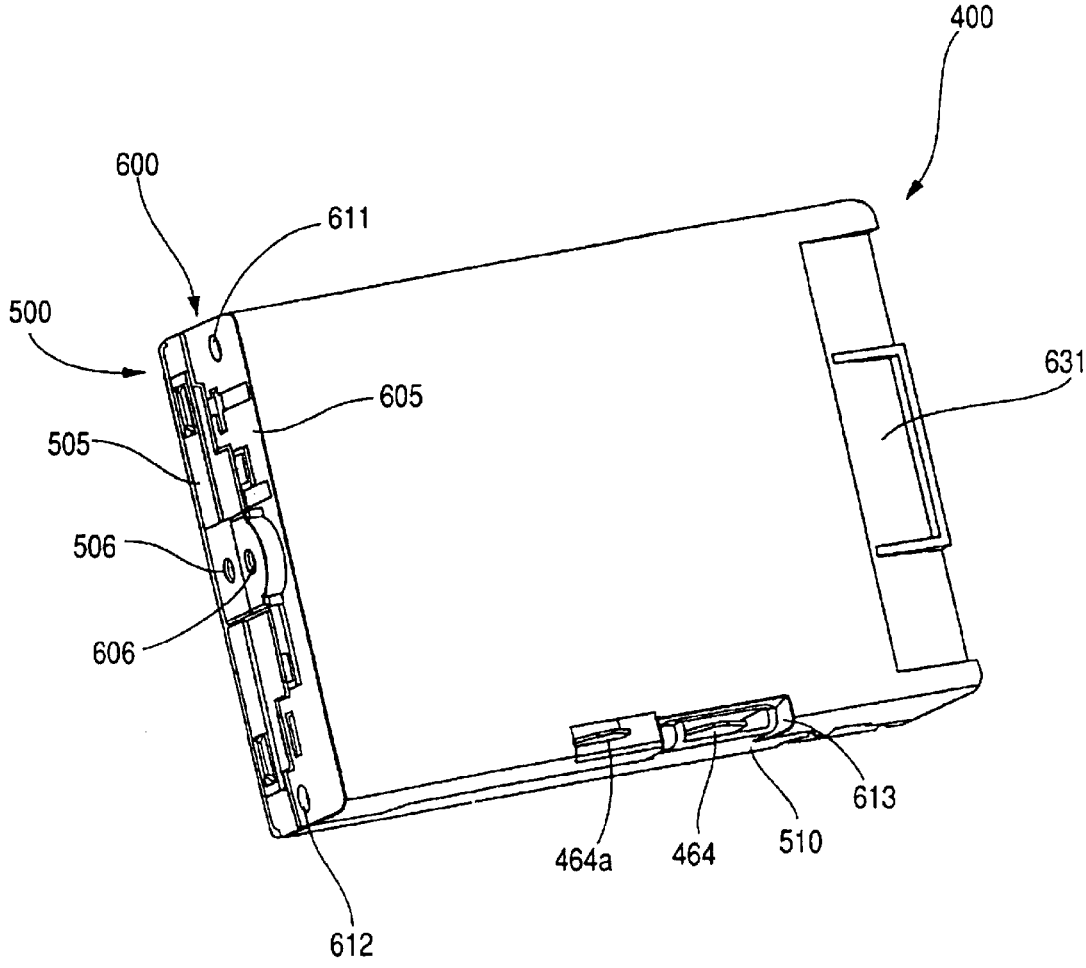
FIG. 19 is an external perspective view of the ink cartridge in FIG. 18 when the ink cartridge is viewed from the bottom.
Figure 21:
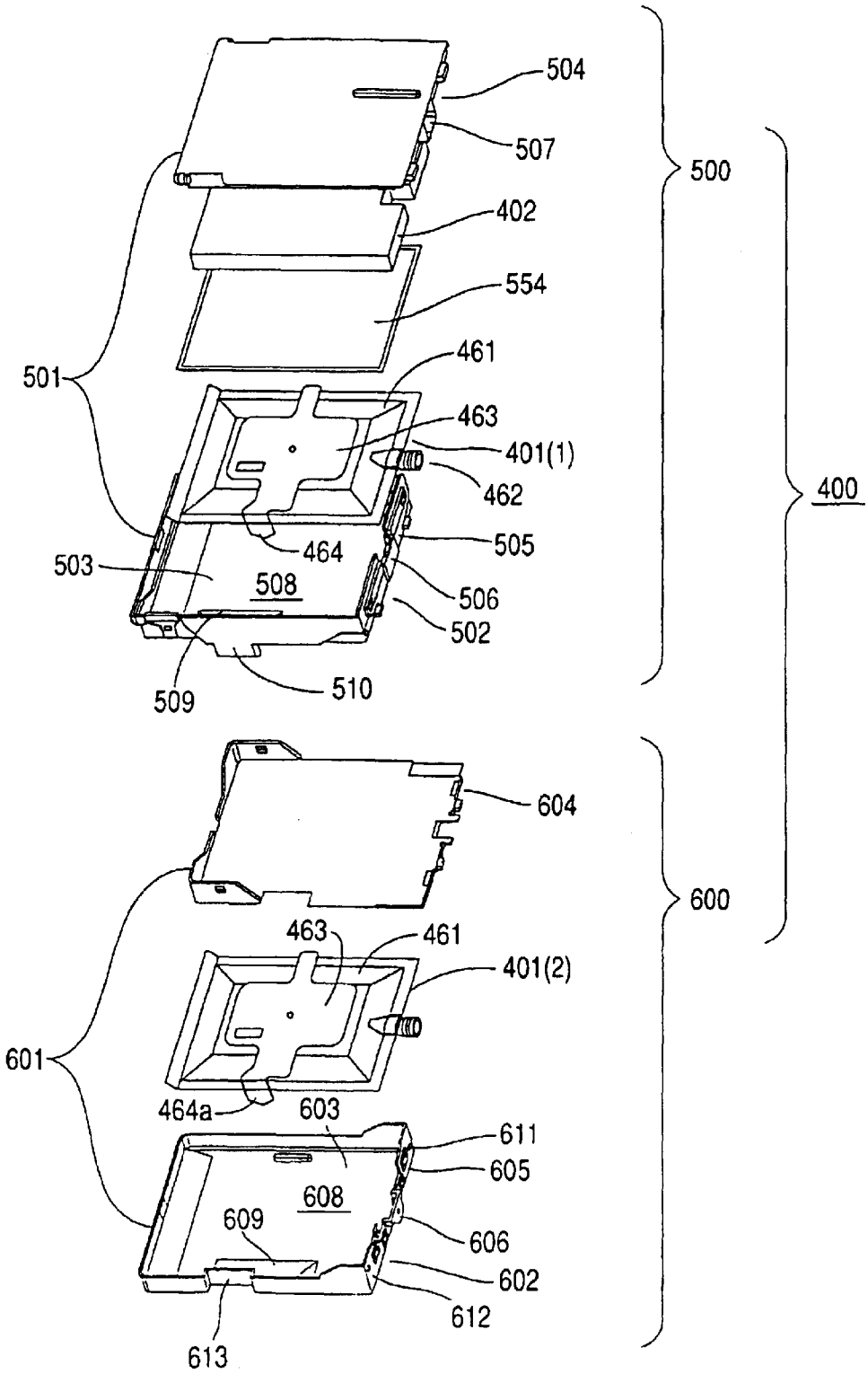
FIG. 21 is an exploded perspective view of the ink cartridge in FIG. 18.

FIG. 18 is an external perspective view of the split-type ink cartridge of this embodiment as the ink cartridge is viewed from the top, FIG. 19 is an external perspective view of the split-type ink cartridge of this embodiment as the ink cartridge is viewed from the bottom, FIG. 20 is a longitudinal sectional view of the split-type ink cartridge, and FIG. 21 is an exploded perspective view of the split-type ink cartridge.

Referring to the figures, an ink cartridge 400 includes a first ink cartridge 500 and a second ink cartridge 600. The ink cartridge 500 is shaped like a flat rectangular parallelepiped in which a first ink bag 401(1) and a waste-ink absorption material 402 are housed. Similarly, the second ink cartridge 600 is shaped like a flat rectangular parallelepiped in which a second ink bag 401(2) is housed. The first and second ink cartridges detachably are joined in a state in which they are overlaid on each other.

The first ink cartridge 500 comprises a cartridge case 501 shaped like a flat rectangular parallelepiped, and the above-mentioned first ink bag 401(1) and waste-ink absorption material 402 are housed in the cartridge case 501. The cartridge case 501 includes a case main body 502 open on its top (upper opening 503) and a case lid 504 detachably covering the upper opening 503. A front end face 505 of the cartridge case 501 is formed with an ink supply needle insertion hole 506 and a waste ink collection needle insertion hole 507. A bottom 508 of the cartridge case 501 is formed with an opening 509 for allowing a detection projection to pass therethrough. Further, a detection projection protection cover 510, extending downward, is formed in the main body case side portion positioned on the side of the opening 509. In the cartridge case 501, the first ink bag 401(1) and the waste-ink absorption material 402 are arranged in this order in the case thickness direction from the bottom 508 of the cartridge case 501.

The second ink cartridge 600 also comprises a cartridge case 601 shaped like a flat rectangular parallelepiped wherein the above-mentioned second ink bag 401(2) is housed. The cartridge case 601 includes a case main body 602 opened to the top (upper opening 603) and a case lid 604 detachably covering the upper opening 603. A front end face 605 of the cartridge case 601 is formed with an ink supply needle insertion hole 606. Guide holes 611 and 612, into which are inserted guide shafts of an ink jet printer (see FIG. 29) as described later, are made in left and right end parts of the main body case front end face 605.

A bottom 608 of the cartridge case 601 is formed with an opening 609 for allowing a detection projection to pass therethrough. The cartridge case 601 also includes a recess part 613 for inserting the detection projection protection cover 510 formed on the first ink cartridge 500. The recess part 613 is formed in the main body case side portion positioned on the side of the opening 609 in the case thickness direction.

Next, the ink bags 401(1) and 401(2) are basically the same except for the ink storage capacity or stored ink and, therefore, the small-capacity ink bag 401(1) storing colored ink will be discussed. Parts of the ink bag 401(2) corresponding to those of the ink bag 401(1) are denoted by the same reference numerals and will not be discussed again. The ink bag 401(1) is formed of a flexible material, such as an aluminum laminate film comprising aluminum foil sandwiched between two films, with a nylon film as the outer film and a polyethylene film as the inner film for enhancing a gas barrier property.

For example, two aluminum laminate films are put on each other and are joined at their peripheries by a method of heat scaling, or the like, whereby a bag main body portion 461 of the ink bag 401(1) is formed. An ink outlet part 462, for removing ink stored in the ink bag, is attached to the front margin center of the bag main body portion 461 by a method of heat sealing, or the like.

The ink outlet part 462 is fixed to the front end face part of the cartridge case 501, and the bag main body portion 461 is fixed to the bottom 508 of the cartridge case 501 with a double-faced adhesive, or the like. The other ink bag 401(2) also has its ink outlet part 462 fixed to the front end face part of the cartridge case 601, and has its bag main body portion 461 fixed to the bottom 608 of the cartridge case with a double-faced adhesive, or the like.

When the first ink cartridge 500 and the second ink cartridge 600 are joined and are overlaid on each other, as seen in FIG. 20, the ink outlet pan 462 of the ink bag 401(1) and the ink outlet part 462 of the ink bag 401(2) arc brought into direct contact with each other in the case thickness direction, and are fixed to the cartridge cases 501 and 601. The configuration for fixing the cartridge cases and the ink bags is similar to the configuration previously described with reference to the accompanying drawing in the first embodiment of the ink cartridge having a partition plate.

Consequently, in the embodiment of the split-type ink cartridge, the ink outlet parts 462 and 462 are also stacked up and down on each other with the parts brought into direct contact with each other, so that the size of the ink cartridge 400 can be minimized and, particularly, the thickness of the ink cartridge 400 can be reduced.

A detection plate 463 is fixed to the ink bag 401(1) by double-faced tape (not shown), or the like. The detection plate 463 is provided for detecting when the amount of ink remaining in the ink bag 401(1) has decreased to a predetermined amount. A detection projection 464, bent at right angles, is formed integrally with the detection plate 463 in a side margin thereof. The detection projection 464 penetrates the opening 509 and is extended into a through hole of the detection projection protection cover 510. When the ink bag 401(1) becomes thin with a decrease in the amount of ink remaining therein, the detection plate 463 accordingly falls toward the bottom 508. Thus, the tip of the detection projection 464 projects downward from the rear of the second ink cartridge 600. When the detection projection 464 projects, it is detected by an ink end sensor of the ink jet printer (described later), so that it is known when the ink runs out.

A detection plate 463 is also attached to the second ink bag 401(2). A detection projection **464*a*, formed in a side margin of the detection plate 463, also passes through the opening 609 made in the bottom 608 and projects downward from the rear as the amount of ink remaining is decreased. Similarly to the situation with detection projection 464, as the amount of ink remaining in bag 401(2) decreases, the detection projection 464*a*** projects downward and is detected by the ink end sensor placed in the ink jet printer (described later).

The detection plate 463 in this embodiment has the same contour shape as the detection plate 8 in the first embodiment of the ink cartridge having a partition plate.

If the detection projection 464 or **464*a* is detected by the common ink end sensor, which detection projection is detected is unknown. However, in this embodiment, the detection projection 464***a* is made narrower than the detection projection 464, so that which of the ink cartridges 500 and 600 has become empty of ink can be immediately recognized by a visual inspection. Of course, the tip shapes of the detection projections may be made different, or the colors can be made different for producing a similar effect.

Figure 22:
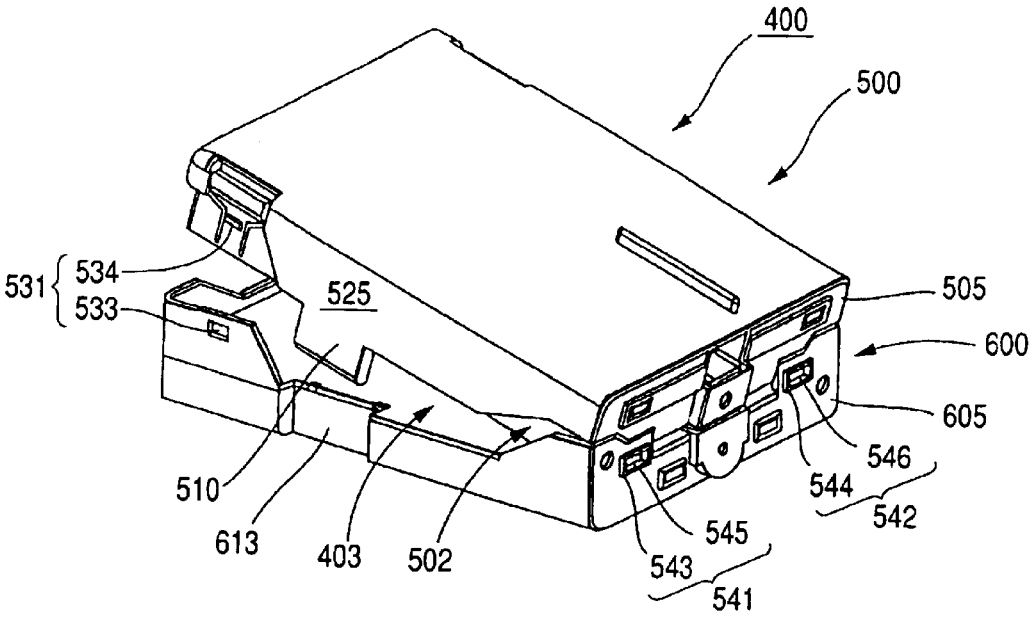
FIG. 22 is a perspective view showing the operation of joining first and second ink cartridges of the ink cartridge in FIG. 18.
Figure 23:
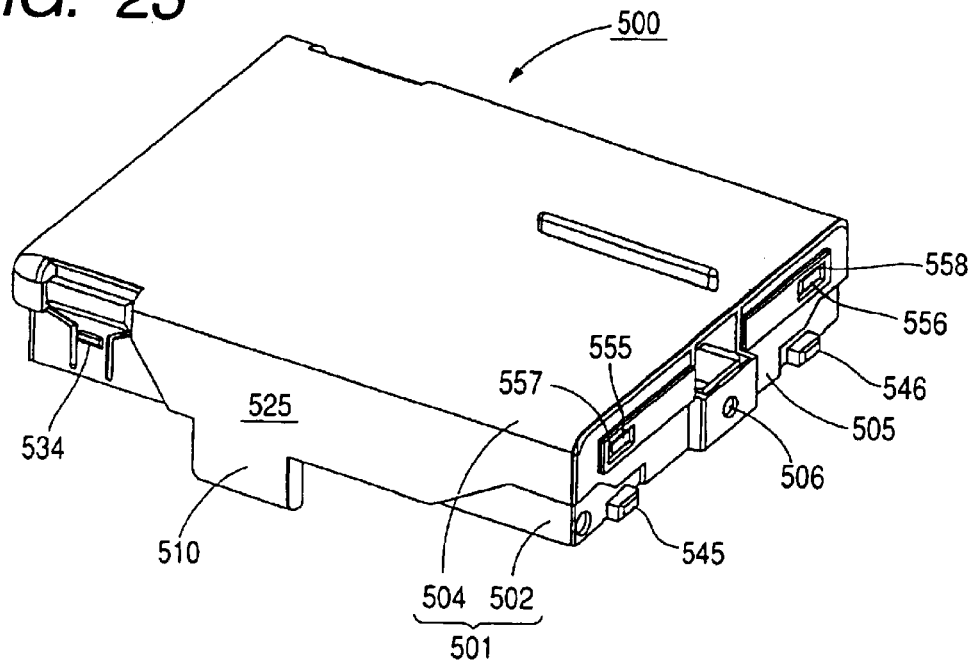
FIG. 23 is a perspective view of the first ink cartridge shown in FIG. 18 when the ink cartridge is viewed from the top.
Figure 24:
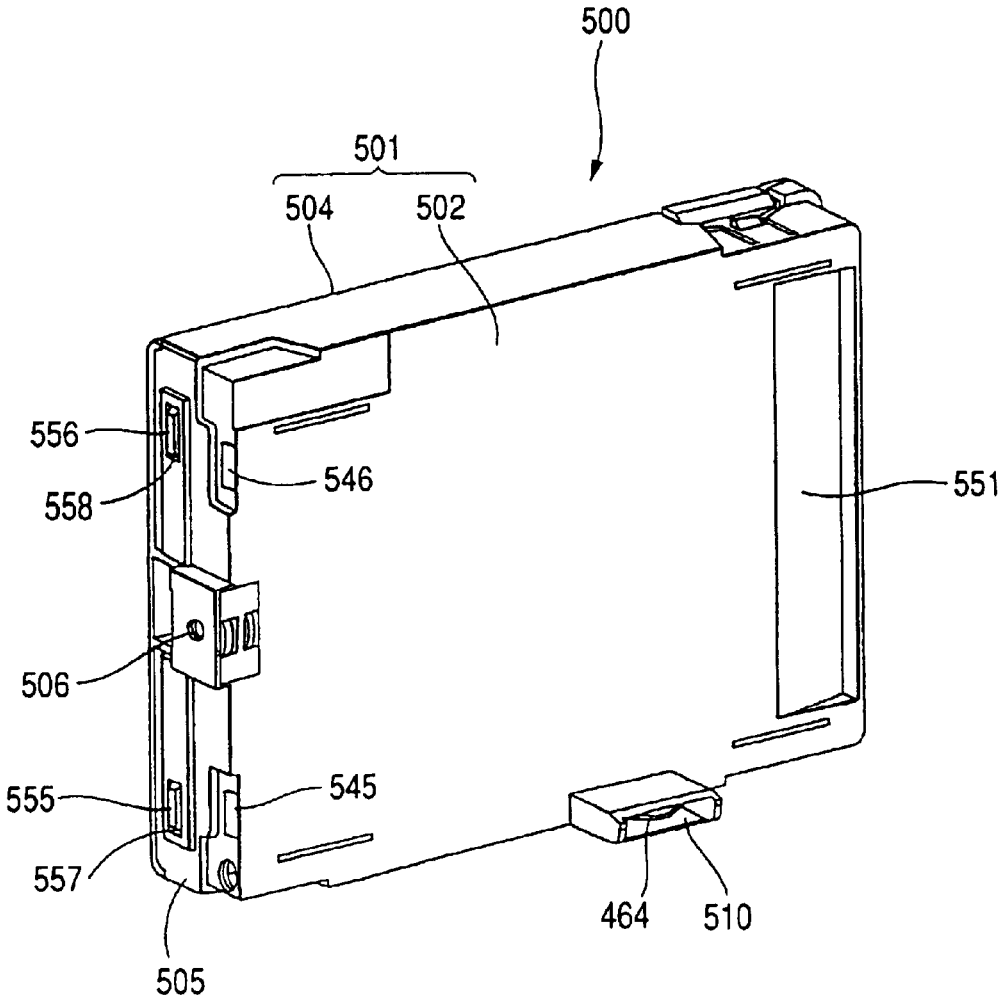
FIG. 24 is a perspective view of the first ink cartridge shown in FIG. 18 when the ink cartridge is viewed from the bottom.
Figure 25:
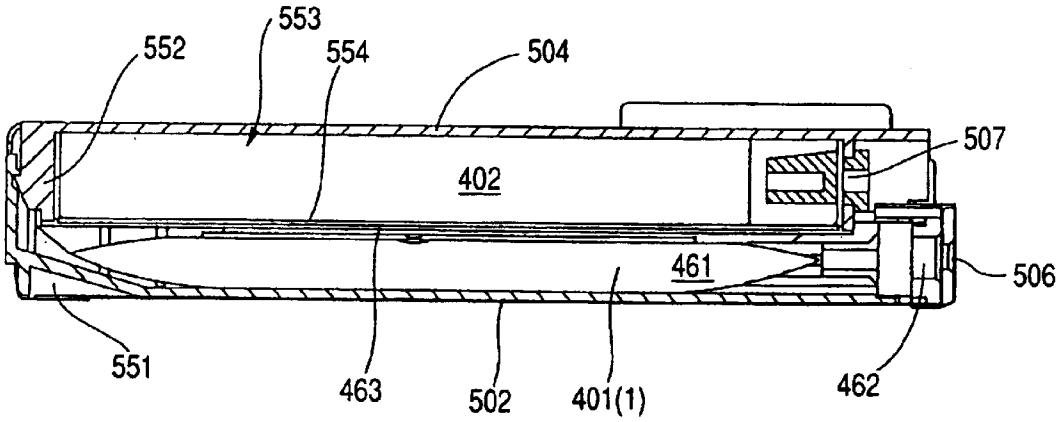
FIG. 25 is a longitudinal sectional view of the first ink cartridge shown in FIG. 18.

Next, FIG. 22 is a perspective view showing the operation of attaching and detaching the first and second ink cartridges 500 and 600. FIGS. 23 to 25 are, respectively, a perspective view of the first ink cartridge 500 when the ink cartridge is viewed from the top, a perspective view of the first ink cartridge 500 when the ink cartridge is viewed from the rear, and a longitudinal sectional view of the first ink cartridge 500.

First, a joint mechanism, which detachably joins the first and second ink cartridges, will be discussed with reference to the figures. The joint mechanism in this embodiment includes a recess 403 in which the first ink cartridge 500 can be placed, wherein the recess 403 is formed on the top of the second ink cartridge 600, left and right snap fit parts 531 and 532 formed on both sides of the first and second ink cartridges 500 and 600, and insertion parts 541 and 542 formed in the front end faces of the first and second ink cartridges 500 and 600.

Figure 26:
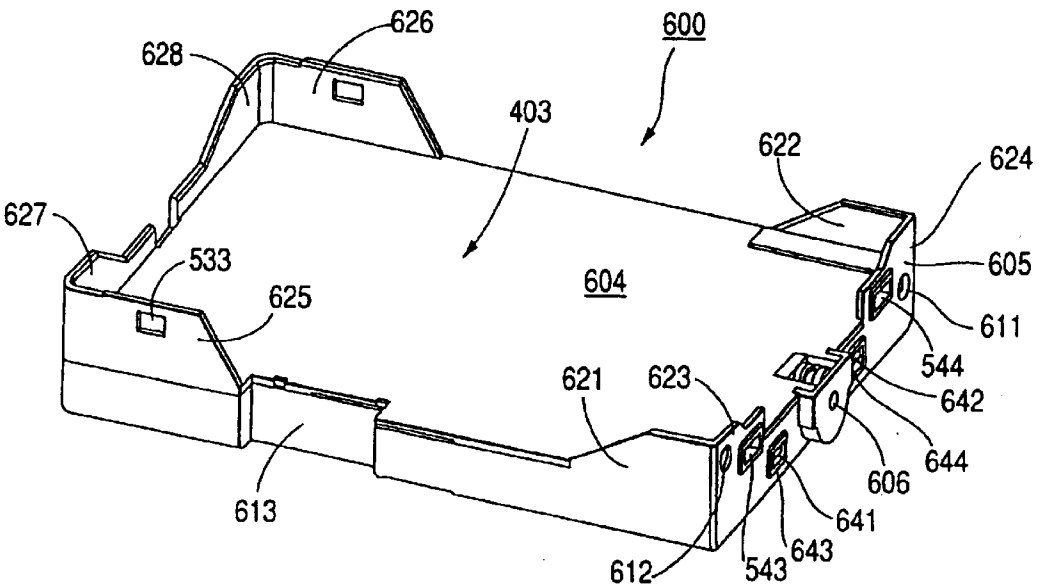
FIG. 26 is a perspective view of the second ink cartridge shown in FIG. 18 when the ink cartridge is viewed from the top.

As seen in FIG. 26, the recess 403 is defined by side plate portions and end plate portions that extend upward from the four corner portions of the case lid 604 on the top of the second ink cartridge 600. That is, left and right side plate portions 621 and 622 and left and right end plate portions 623 and 624 are formed on the front end side of the case lid 604 and, likewise, side plate portions 625 and 626 and end plate portions 627 and 628 are formed on the rear end side. The rear portion of the case main body 502, of the first ink cartridge 500, can be fitted into the recess 403 by inserting it from the upper side.

The snap fit parts 531 and 532 are formed between the side plate portions 625 and 626 on the rear end side, and the left and right side portions of the case main body 502 of the first ink cartridge 500 opposed to the side plate portions 625 and 626. More particularly, the snap fit part 531 is made up of an engagement hole 533 in the case lid side plate portion 625 of the second ink cartridge 600, and of an engagement projection 534 formed on the side portion 525 of the case main body 502 of the first ink cartridge 500. If the rear end portion of the first ink cartridge 500 is pushed into the recess 403 of the second ink cartridge 600, the side plate portion 625 and the side portion 525 are elastically displaced relative to one another and the engagement projection 534 is fitted into the engagement hole 533, whereby the first and second ink cartridges are joined. The other snap fit part 532 has the same structure as the snap fit part 531 and, therefore, it will not be discussed again.

Insertion holes 543 and 544 are made in the front end plate portions 623 and 624 of the second ink cartridge 600, and insertion projections 545 and 546 are formed at corresponding positions on the front end face 505 of the case main body 502 of the first ink cartridge 500. Therefore, as shown in FIG. 22, if the front end portion of the first ink cartridge 500 is inserted into the recess 403 of the second ink cartridge 600 from the upper side and is pushed out forward, the insertion projections 545 and 546 are inserted into the corresponding insertion holes 543 and 544, forming the left and right insertion parts 541 and 542.

After this, as described above, if the rear end portion of the first ink cartridge 500 is pushed into the recess 403, the left and right snap fit parts 531 and 532 are formed. Consequently, the first and second ink cartridges 500 and 600 are joined in a state in which they are overlaid on each other, in the case thickness direction. To separate the first and second ink cartridges 500 and 600, if the left and right snap fit parts 531 and 532 are disengaged from each other and the rear end portions of the first and second ink cartridges 500 and 600 are separated as shown in FIG. 22 and then the first ink cartridge 500 is pulled relatively backward, the insertion parts 541 and 542 are detached and both ink cartridges 500 and 600 can be separated completely.

Thus, in the ink cartridge 400 of this embodiment, the first ink cartridge 500 is fitted into the recess 403 formed in the second ink cartridge 600. Therefore, there is no risk that both ink cartridges 500 and 600 may relatively shift back and forth or left and right. Thus, when the ink cartridge 400 is placed in or detached from the cartridge placement section of the ink jet printer, relative movement between the first and second ink cartridges 500 and 600—which relative movement would tend to separate the cartridges 500 and 600—is prevented by the recess 403. Therefore, when the ink cartridge 400 is attached or detached, the first and second ink cartridges 500 and 600 can be reliably prevented from shifting and being separated.

In this embodiment, the front end portions of the first and second ink cartridges 500 and 600 are joined in the insertion manner and then the rear end portions are joined in the snap fit manner, so that both ink cartridges 500 and 600 are easily positioned and can be easily joined. Further, there is no worry that the first and second ink cartridges 500 and 600 will be accidentally separated.

Next, referring mainly to FIGS. 23 to 25, the structures of the parts of the first ink cartridge 500 will be discussed. The case main body 502, forming a part of the cartridge case 501, has a rear end portion inclined so that an elongated rectangular knob recess 551, which is triangular in cross section, is formed. Since the knob recess 551 is formed, if the first ink cartridge 500 is separated from the second cartridge 600, it becomes easy to grasp the first ink cartridge 500 and the risk of dropping and breaking the first ink cartridge 500 is reduced.

The case lid 504, attached to the opening 503 of the case main body 502, is formed on the rear with a rectangular frame 552. The waste-ink absorption material 402 is housed in a recess 553 formed by the rectangular frame 552, and is sealed in the recess 553 with a plastic film 554.

The case lid 504 is fitted into the opening 503 of the case main body 502, and is formed on its front end portion with a pair of left and right insertion projections 555 and 556, whereas the case main body 502 is formed on its front end face 505 with insertion holes 557 and 558 at the positions corresponding to the insertion projections 555 and 556. Further, the case lid 504 and the case main body 502 are formed with engagement claws of snap fit type and engagement grooves in which can be fitted the engagement claws. The engagement claws are as previously described with reference to FIG. 6 in the first embodiment of the ink cartridge. The case lid 504 is thus attached to the case main body 502 by engaging the engagement claws and engagement grooves. Thus, the case lid 504 is easily removed from the case main body 502, so that the first ink cartridge 500 can be disassembled easily when it is recycled.

Figure 27:
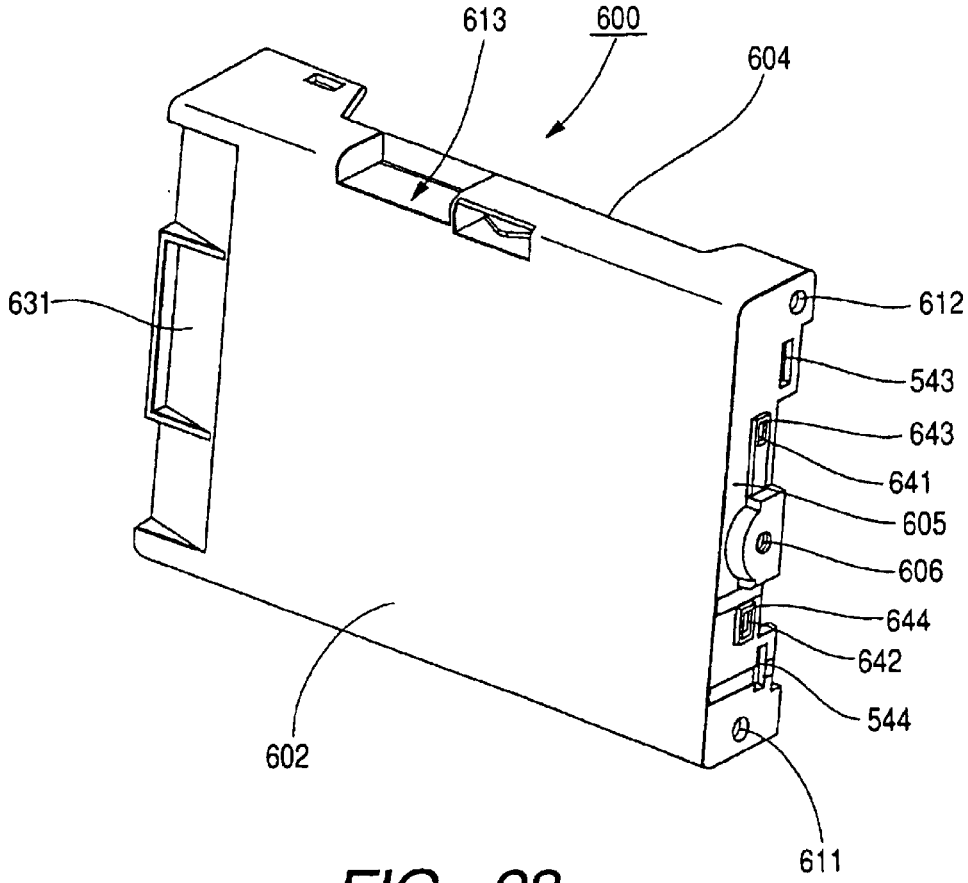
FIG. 27 is a perspective view of the second ink cartridge shown in FIG. 18 when the ink cartridge is viewed from the bottom.
Figure 28:
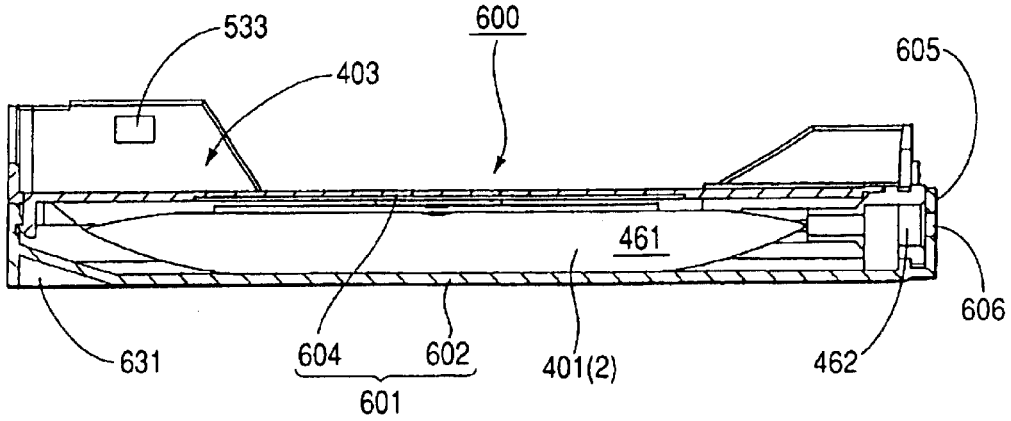
FIG. 28 is a longitudinal sectional view of the second ink cartridge shown in FIG. 18.

Next, referring mainly to FIGS. 26 to 28, the structure of the second ink cartridge 600 will be discussed. The case main body 602, forming a part of the cartridge case 601, has a rear end portion inclined so that an elongated rectangular knob recess 631, which is triangular in cross section, is formed. Since the knob recess 631 is formed, the ink cartridge 400 is easy to grasp, and the risk of dropping and breaking the ink cartridge is reduced. Even after the second ink cartridge 600 is separated from the first ink cartridge 500, the knob recess 631 can be used as a knob to grasp the second ink cartridge 600.

The case lid 604, attached to the opening 603 of the case main body 602, is fitted into the opening 603 of the case main body 602 and is formed on its front end portion with a pair of left and right insertion projections 641 and 642, whereas the case main body 602 is formed on its front end portion 605 with insertion holes 643 and 644 at corresponding positions. Further, the case lid 604 and the case main body 602 are formed with engagement claws of a snap-fit type and engagement grooves in which the engagement claws can be fit as with the first ink cartridge 500. The case lid 604 is attached to the case main body 602 by engaging the engagement claws with the engagement grooves in an insertion manner. Thus, the case lid 604 is easily removed from the case main body 602, so that the second ink cartridge 600 can also be disassembled easily when it is recycled.

The waste-ink holding capacity of the waste-ink absorption material 402 now will be discussed with reference to Tables 1 and 2.

Let the volume of color ink available until the detection projection 464 of the detection plate 463 fixed to the first ink bag 401(1) is detected by an ink end sensor of ink jet printer (described later) be V1.

Likewise, let the volume of color ink available until the detection projection 464*a* of the detection plate 463 fixed to the second ink bag 401(2) is detected by the ink end sensor of the ink jet printer be V2.

Let the number of ink nozzles of an ink jet head 709 (described later) for ejecting color ink be n1 and the number of ink nozzles for ejecting black ink be n2.

If printing with color ink is not executed, a plurality of second ink cartridges 600 storing black ink (p second ink cartridges 600 in Table 1) can be used by the time one first ink cartridge 500 storing color ink is used up, as listed in Table 1.

That is, even when color ink is not used for printing, it is used during preliminary ejecting of the ink jet head 709, and is also used during recovery processing of a head cap 712 and a waste ink pump 714 (described later), thereby producing waste ink.

In Table 1, the volume of color ink used as waste ink while the first ink cartridge 600 is used is shown as b1 (cc), and the volume of black ink used for printing is shown as a1 (cc).

Since the number of ink nozzles for ejecting black ink is (n2/n1) times the number of ink nozzles for ejecting color ink, the volume of waste ink produced from black ink also becomes (n2/n1) times the volume of waste ink produced from color ink. Thus, the waste ink volume of black ink produced while the first ink cartridge 600 is used can be represented as b1(n2/n1) (cc).

Likewise, if the volume of color ink used as waste ink while the second ink cartridge 600 is used is shown as b2 (cc), and the volume of black ink used for printing is shown as a2 (cc), the waste ink volume of black ink can be represented asb2(n2/n1) (cc).

A similar representation can also be made concerning thep'th ink cartridge 600. Thus, the following relational expressions hold as listed in Table 1:

Concerning the second (black ink) cartridge 600, $$a1+b1(n2/n1)=a2+b2(n2/n1)= \ldots =ap+bp(n2/n1)=V2$$

Concerning the first (color ink) cartridge 500, $$b1+b2+\ldots+bp=\Sigma bi=V1$$

Concerning the amount of waste ink produced, $$\Sigma bi(n2/n1)+\Sigma bi=\Sigma bi((n1+n2)/n1)=V1((n1+n2)/n1)$$

Next, to print also with color ink, it is assumed that q second ink cartridges 600 storing black ink are used by the time one first ink cartridge 500 storing color ink is used up, as listed in Table 2. Here, the relation of q<p holds. If the volume of color ink used for printing—while the first ink cartridge 600 is used—is shown as c1 (cc), and the volume of color ink used as waste ink is shown as e1 (cc), and the volume of black ink used for printing is shown as d1 (cc), the volume of black ink used as waste ink can be represented as e1(n2/n1) (cc).

A similar representation can also be made concerning theq'th ink cartridge 600. Thus, the following relational expressions hold as listed in Table 2:

Concerning the second (black ink) cartridge 600, $$d1+c1(n2/n1)=d2+e2(n2/n1)= \ldots dq+eq(n2/n1)=V2$$

Concerning the first (color ink) cartridge 500, $$(c1+\ldots+cq)+(e1+\ldots+eq)=\Sigma ci+\Sigma ei=V1$$

Concerning the amount of waste ink produced, $$\Sigma ei(n2/n1)+\Sigma ei=\Sigma ei((n1+n2)/n1)=((n1+n2)/n1)(V1-\Sigma ci)\leqq V1((n1+n2)/n1)$$

That is, in this embodiment, if the waste ink absorption material 402 has a waste-ink holding capacity S of V1((n1+n2)/n1) or more, waste ink does not leak.

The available color ink volume V1 generally varies by about ±15%. As the capacity (volume) of the waste-ink absorption material 402 is smaller, it is more advantageous for miniaturization of the ink cartridge using the waste-ink absorption material 402, and also more advantageous for the ink jet printer in which the ink cartridge is placed. Thus, it is desired that the waste-ink holding capacity S of the waste-ink absorption material 402 be 1.3 or less times V1((n1+n2)/n1).

Next, in contrast to the above-described embodiment, if the first ink bag 401(1) housed in the first ink cartridge 500 stores black ink, the second ink bag 401(2) housed in the second ink cartridge 600 stores color ink, the available black ink volume is V2, the available color ink volume is V1, the number of ink nozzles for ejecting black ink is n2, and the number of ink nozzles for ejecting color ink is n1, the amount of waste ink produce when printing with black ink is not executed—can be represented by the following expression:

$$V2((n1+n2)/n2)$$

Thus, in this case, if the waste ink absorption material has a waste-ink holding capacity M of V2((n1+n2)/n2) or more, waste ink does not leak.

Now will be discussed which of the following cases allows the waste-ink holding capacity to be smaller (i) where an ink bag storing color ink and a waste-ink absorption material are housed in one ink cartridge; or (ii) where an ink bag storing black ink and a waste-ink absorption material are housed in one ink cartridge.

$$S/M=(V1(n1+n2)/n1)/(V2(n1+n2)/n2)=(V1/n1)/(V2/n2)$$

The value resulting from dividing the available color ink volume V1 by the number of ink nozzles for ejecting color ink, n1, is compared with the value resulting from dividing the available black ink volume V2 by the number of ink nozzles for ejecting black ink, n2. If a waste ink absorption material is housed in the ink cartridge having the smaller value, the waste-ink holding capacity may be smaller.

That is, the waste ink absorption material is attached to the ink cartridge having the smaller value resulting from dividing the available ink volume by the number of ink nozzles for ejecting the corresponding ink, whereby the waste ink absorption material having the smaller waste-ink holding capacity can prevent waste ink from leaking.

Figure 29:
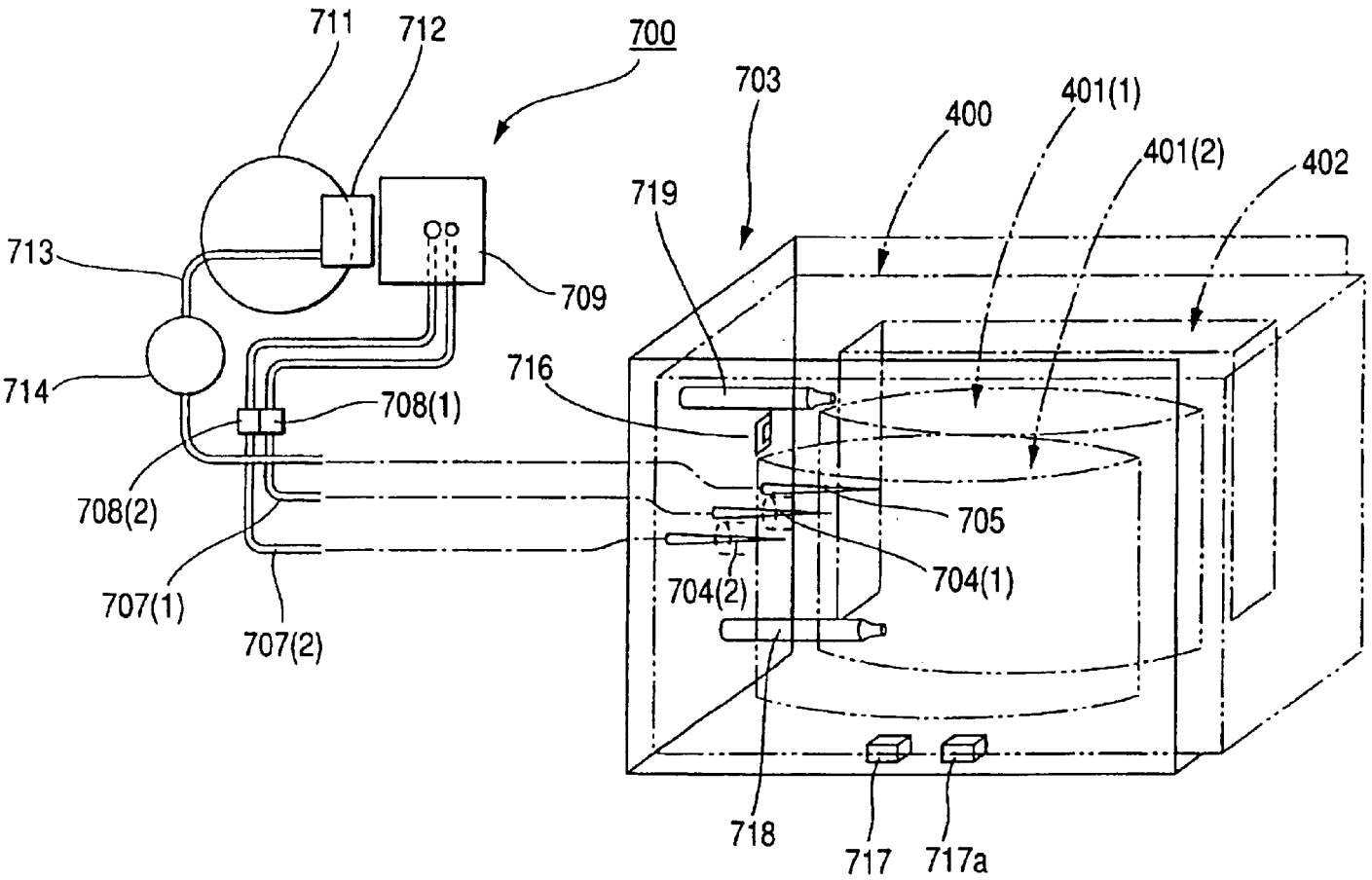
FIG. 29 is a schematic configuration drawing to show ink supply and collection channels of an ink jet printer using the ink cartridge in FIG. 18 as an ink supply source.

Sixth Embodiment—An Ink Jet Printer using an Ink Cartridge 400 as an Ink Supply Source FIG. 29 is a schematic configuration drawing showing an example of an ink jet printer in which the above-described split-type ink cartridge can be placed as an ink supply source. The basic configuration of an ink jet printer 700 of this embodiment is similar to that of a generally used ink jet printer and, therefore, is not shown, whereas only ink supply and discharge channels arc shown. Also, only the ink supply and discharge channels will be discussed.

Referring to FIG. 29, the ink jet printer 700 of this embodiment includes a cartridge placement section 703 in which the ink cartridge 400 detachably is placed. Two ink supply needles 704(1) and 704(2) and one waste ink collection needle 705 are attached to the cartridge placement section 703 so that they extend horizontally at the same height positions. If the needles 704(1), 704(2), and 705 respectively are inserted into the ink supply needle insertion holes 506 and 606 and the waste ink collection needle insertion hole 507 of the ink cartridge 400, ink flow passages for supplying and discharging ink are formed between the ink cartridge 400 and the ink jet printer 700.

When the ink flow passages arc formed, ink stored in the first ink bag 401(1) and ink in the second ink bag 401(2) arc taken out into ink supply tubes 707(1) and 707(2) through the ink supply needles 704(1) and 704(2). In the ink cartridge 400, red colored ink, or the like, is stored in the first ink bag 401(1), whereas black ink is stored in the second ink bag 401(2). Thus, colored ink is supplied through the ink supply tube 707(1) and black ink is supplied through the ink supply tube 707(2). Filters 708(1) and 708(2) filter dust and foreign substances from the ink, and are placed at midpoints of the ink supply tubes 707(1) and 707(2).

Ink is introduced into an ink jet head 709, of the ink jet printer 700, through the ink supply tubes 707(1) and 707(2). The ink jet head 709 is mounted on a carriage (not shown) and is reciprocated in the length direction along the surface of a platen 711. Record paper (not shown) is transported in a direction orthogonal to the ink jet head's movement direction along the surface of the platen 711, and is printed with the ink jet head 709.

To maintain the print quality of the ink jet head 709, ink nozzles of the ink jet head 709 are cleaned by sucking ink therefrom (recovery processing). For this purpose, a head cap 712 is placed at a position out of a print area of the ink jet head 709, and the ink jet head 709 periodically is moved to the position of the head cap 712. A waste ink tube 713, for collecting waste ink collected or sucked from the ink jet head 709 by way of the head cap 712, is connected to the head cap 712. A waste ink pump 714, as a drive source for collecting waste ink, is connected to the waste ink tube 713.

The waste ink passes through the waste ink tube 713 by action of the waste ink pump 714. The waste ink then passes through the waste ink collection needle 705 and into the waste-ink absorption material 402 wherein it is collected and held.

Further in this embodiment, a cartridge presence/absence sensor 716 is attached to the cartridge placement section 703, and detects placement or no placement of the ink cartridge 400 by sensing the front end face of the side where the color ink bag 401(1) is housed in the ink cartridge 400. Two ink end detectors 717 and **717*a* are attached to the cartridge placement section 703 and, when the detection projection 464 or 464*a* attached to the ink cartridge 400 is detected, produce an output indicating which of color ink and black ink remains only a little. In addition, two guide shafts 718 and 719, for guiding placement of the ink cartridge 400**, are attached in the cartridge placement section.

The split-type ink cartridge 400 can be placed in the cartridge placement section 703 of the ink jet printer 700 with the first and second ink cartridges 500 and 600 together in one piece. Therefore, the ink cartridge attachment/detachment operation is easy as compared with the case where an ink cartridge for each color is placed or removed.

If the ink cartridge that becomes empty of ink is detected by the ink end sensor 717 or **717*a***, only the ink cartridge that becomes empty of ink needs to be replaced, so that waste of ink—as is in an ink cartridge containing a plurality of ink bags—does not occur.

In this embodiment, black ink used in a large amount is filled into the large-capacity ink bag 401(2) housed in the second ink cartridge 600 in which the waste-ink absorption material 402 is not housed, whereas color ink used in a small amount is stored in the first ink cartridge 500 in which the waste-ink absorption material 402 is housed. Therefore, the ink cartridge replacement frequency can be decreased as compared with the case where black ink is stored in the first ink cartridge 500.

Also in this embodiment, the two guide shafts 718 and 719 horizontally project into the cartridge placement section 703. Further, the guide shaft insertion holes 611 and 612, into which the guide shafts 718 and 719 can be inserted, are made only in the front end face of the second ink cartridge 600. Therefore, if the ink cartridge 400 is placed in the cartridge placement section 703 in an opposite direction left to right, the tip of the guide shaft 718, 719 abuts the front end face or the rear end face of the ink cartridge 400. Thus, the ink cartridge 400 is prevented from being placed in the cartridge placement section 703 in an erroneous position.

According to the configuration of the split-type ink cartridge 400 and the cartridge placement section 703 in this embodiment, the first ink cartridge 500 alone can be placed in the cartridge placement section 703. In this case, the cartridge presence/absence sensor 716 installed in the cartridge placement section 703 detects the first ink cartridge 500 as if the ink cartridge 400 were placed. If the ink jet printer 700 is driven in this state, the second ink cartridge 600 storing black ink is not placed and it is impossible to print in black ink, thus the operator immediately recognizes the state in which the second ink cartridge 600 is not placed.

The waste ink collection channel prevents the detrimental effect of leaking out waste ink to the outside. Of course, if two cartridge presence/absence sensors for detecting the first and second ink cartridges 500 and 600 are attached, when the operator forgets about placing the black ink cartridge 600, he or she can be informed of the fact.

In this case, to reliably prevent waste ink from leaking from the waste ink absorption material, the waste ink absorption material is housed in the ink cartridge having the smallest value resulting from dividing the volume of ink stored in each ink cartridge by the number of ink nozzles of the ink jet-printer for ejecting the corresponding ink, whereby even with the smaller waste-ink holding capacity, waste ink can be reliably prevented from leaking.

The split-type ink cartridge 400 includes the waste-ink absorption material, but of course the invention can also be applied to a split-type ink cartridge having no waste-ink absorption material. Further, the waste-ink holding member for storing waste ink from the ink jet printer is not limited to the waste ink absorption material, but may be any if it can hold liquid waste ink, such as a bag, of course.

The split-type ink cartridge 400 includes two ink cartridges joined, but of course the invention can also be applied to a split-type ink cartridge comprising three or more ink cartridges joined together.

Further, waste ink—produced from the ink jet printer comprising a plurality of ink nozzle groups for separately ejecting different types of inks from a plurality of ink cartridges storing the inks, which cartridges can be attached and detached separately—can be held reliably with a small capacity. Therefore, the invention can also be applied to a plurality of ink cartridges wherein a waste-ink holding member for collecting and holding waste ink is placed in the ink cartridge having the smallest value resulting from dividing the volume of ink available to the ink jet printer, as stored in each ink cartridge, by the number of ink nozzle groups for ejecting the corresponding ink.

Further, to detect the ink end condition of each ink bag in the split-type ink cartridge 400, the ink end condition detection mechanism shown in FIGS. 13 to 17 and as described above can also be adopted intact.

The ink jet printer of the invention can also be applied to other machines that print, such as facsimile machines, or the like.

As described above, in the ink cartridge having a partition plate, a plurality of housed ink bags are overlaid on each other in the case thickness direction in a state in which their ink outlet parts are in direct contact with each other without sandwiching a partition plate between the ink outlet parts. Generally, the outer size of the ink outlet part is larger than the thickness of the ink bag when the ink bag main body is filled with ink, so that the ink cartridge can be thinned by placing no partition plate between the ink outlet parts, and thus it is advantageous for miniaturizing the ink cartridge.

The partition plate placed between the ink bags is mounted in a slidable state relative to the cartridge case, and is sandwiched between the case main body and the case lid forming the cartridge case, whereby the installation position of the partition plate is defined. Therefore, the partition plate can be easily installed and removed, whereby it is easy to disassemble and assemble the ink cartridge when the ink cartridge is recycled, and the like.

Further, the ink outlet parts of the ink bags overlaid on each other in the case thickness direction are pressed and fixed by a portion that can be elastically displaced in the case thickness direction, so that the ink outlet parts can be reliably fixed to their predetermined positions. Consequently, the ink supply needle can always be inserted into the appropriate position.

Further, the ink outlet parts of the ink bags placed in the case thickness direction are used to fix the partition plate, so that the partition plate holding each ink bag can be reliably fixed to the predetermined position. Consequently, the position of the ink bag held on the partition plate can also be defined with good accuracy, so that it is possible for the detection plate attached to the ink bag to detect, with good accuracy, when the ink runs out.

Next, in the split-type ink cartridge, the ink outlet parts of the ink bags housed in the first and second ink cartridges are overlaid on each other so that they are in direct contact with each other in the case thickness direction. Because of this direct contact, the ink cartridge can be miniaturized as compared with the case wherein each ink cartridge intervenes.

The first and second ink cartridges are joined in a detachable state. Therefore, the operation of attaching and detaching the ink cartridge (including multiple colors of ink) to and from the cartridge placement section of the ink jet printer can be performed easily and efficiently as compared with the case where two ink cartridges are attached and detached separately.

Further, if an ink cartridge becomes empty of ink, only the ink cartridge which becomes empty of ink needs to be replaced, so that the detrimental effect of replacing an ink cartridge wherein a large amount of ink remains in one ink bag as with the ink cartridge housing a plurality of ink bag—can be circumvented, and waste of ink can be reduced.

Further, the joint mechanism of the first and second ink cartridges includes a configuration which prevents a relative shift, so that the cartridges are reliably prevented from being accidentally detached from one another as they are inserted into, or removed from, the cartridge placement section.

In addition, the joint mechanism includes snap fit parts and the insertion parts, so that both ink cartridges can be easily aligned and joined. Further, the erroneous operation of forcibly joining both ink cartridges in an erroneous orientation can also be prevented.

Still further, the snap fit parts of the joint mechanism are formed in the side portions that are not touched by the operator operating the ink cartridge, and are not exposed to the outside. Therefore, there is little risk that the snap fit parts may be detached when the ink cartridge is attached or detached. If the ink cartridge is dropped by mistake, the risk of breaking the components of the snap fit parts is also small.

Also, in the ink cartridge of the invention, the contour shape and thickness of the detection plate attached to the ink bag are set so as to appropriately correspond to the contour shape of the bag main body of the ink bag.

Therefore, the amount of ink remaining when the ink end is detected can be reduced, so that the amount of wasted ink can be decreased. Since the detection plate can be moved in connection with the deformation of the ink bag as the amount of ink remaining decreases, ink end detection with good accuracy can be accomplished.

Moreover, the detection projections, to detect the ink amounts remaining in the first and second ink bags, are made different in shape or color so that it can easily and conveniently be recognized, by visual inspection, which of the ink cartridges becomes empty of ink.

In the split-type ink cartridge of the present invention, the waste-ink holding member—for collecting and holding waste ink entered therein from the outsides attached to the ink cartridge having the smallest value resulting from dividing the volume of ink available to the ink jet printer, as stored in each ink cartridge, by the number of ink nozzles of the ink jet printer for ejecting the corresponding ink.

Therefore, only one of the ink cartridges is provided with the waste-ink holding member, so that the whole volume of the ink cartridge is reduced whereby the ink cartridge can be miniaturized as compared with the case where every ink cartridge is provided with a waste-ink holding member.

In addition, the waste-ink holding capacity of the waste-ink holding member is set to the value resulting from multiplying (i) the volume of ink available to the ink jet printer, as stored in the ink cartridge having the waste-ink holding member, by (ii) the total number of ink nozzles of the ink jet printer divided by the number of the ink nozzles for ejecting the ink stored in the ink cartridge having the waste-ink holding member.

Therefore, even the waste-ink holding member having a smaller waste-ink holding capacity can reliably prevent waste ink from leaking from the waste-ink holding member.

What is claimed is:

1. An ink cartridge comprising:

a cartridge main body having a first case and a second case joined to the first case;

first and second ink bags each comprising a bag main body storing ink and an outlet through which the ink can be discharged from the bag main body, the first and second ink bags being housed by the first case and the second case, wherein when the first case and the second case are joined, the outlets of the first and second ink bags are pressed directly against each other by the first case and the second case; and a partition plate attached to a predetermined position of the first case, said partition plate separating compartments housing the first ink bag and the second ink bag respectively, wherein the partition plate is detachable in a direction substantially perpendicular to the bottom plate portion along the side plate portion, and wherein each of the first case and the second case comprises a partition plate clamp face such that the partition plate is clamped by the partition plate clamp face of the first case and the partition plate clamp face of the second case for defining the position of the partition plate.

2. The ink cartridge as claimed in claim 1, wherein the first case comprises a bottom plate portion and a side plate portion, the first case having an opening on a top thereof for housing the first and second ink bags, wherein the second case covers the opening of the first case.

3. The ink cartridge as claimed in claim 2, further comprises a waste-ink holding member for storing waste ink poured therein from the outside thereof, said waste-ink holding member attached to the second case.

4. The ink cartridge as claimed in claim 2, wherein each of the first case and the second case comprises an ink outlet clamp face such that the ink outlets are clamped by the ink outlet clamp faces for defining the positions of the ink outlets, and wherein at least one of the ink outlet clamp faces is elastically displaceable.

5. The ink cartridge as claimed in claim 1, wherein each of the ink outlets comprises a contact portion in contact with each other and a clamp portion clamping the partition plate with one another.

6. An ink cartridge comprising:

a cartridge main body having a first case and a second case joined to the first case;

first and second ink bags each comprising a bag main body storing ink and an outlet through which the ink can be discharged from the bag main body, the first and second ink bags being housed by the first case and the second case, wherein when the first case and the second case are joined, the outlets of the first and second ink bags are pressed directly against each other by the first case and the second case;

a partition plate attached to a predetermined position of the first case, said partition plate separating compartments housing the first ink bag and the second ink bag respectively;

a first detection plate attached to the first ink bag, and having a first detection projection extended in a direction substantially perpendicular to the bottom plate portion, the first detection projection moving in the direction substantially perpendicular to the bottom plate portion and projecting from the cartridge main body in response to the consumption of ink in the first bag main body; and a second detection plate attached to the second ink bag, and having a second detection projection extended in the direction substantially perpendicular to the bottom plate portion, the second detection plate moving in the direction substantially perpendicular to the bottom plate portion and projecting from the cartridge main body in response to the consumption of ink in the second bag main body, wherein the first and second detection projections differ from each other at least in shape or color.

7. The ink cartridge as claimed in claim 6, wherein the first and second detection plates are put on surfaces of the bag main bodies of the first and second ink bags, and the plane form of each detection plate overlapping the corresponding bag main body is rectangular, wherein the width dimension of each detection plate, measured in a direction along the side where the ink outlets of the first and second ink bags are attached, is a value within the range of 0.5 to 1.0 times the width dimension of the corresponding ink bag measured in the direction along the side where the ink outlets of the first and second ink bags are attached, and further wherein the length dimension of each detection plate is a value within the range of 0.4 to 0.8 times the length dimension of each ink bag.

8. The ink cartridge as claimed in claim 7, wherein the ratio between: (i) the ratio between the width dimensions of the first and second detection plates and the width dimensions of the bag main bodies of the first and second ink bags; and (ii) the ratio between the length dimension of each detection plate and the length dimension of the bag main body of each ink bag, is within the range of 0.8 to 1.2.

9. An ink cartridge comprising:

a plurality of ink cartridges including a first ink cartridge for housing a first ink bag storing first ink, and a second ink cartridge for housing a second ink bag storing second ink of a different color than the first ink, each of the first and second ink bags having an outlet through which the ink can be discharged, the ink cartridges being detachably joined by a joint mechanism, wherein the joint mechanism comprises at least one insertion projection engageable with a corresponding at least one insertion hole, and wherein when the ink cartridges are joined, the outlets of the first and second ink bags are pressed directly against each other.

10. The ink cartridge as claimed in claim 9, wherein the first ink bag has a first bag main body and a first detection plate moved in a thickness direction of the first bag main body in response to the amount of ink remaining in the first bag main body, and the second ink bag has a second bag main body and a second detection plate moved in a thickness direction of the second bag main body in response to the amount of ink remaining in the second bag main body, wherein first and second detection projections are extended in the thickness direction of the first and second bag main bodies from side margins of the first and second detection plates, and have tips projected from the rear of the second ink cartridge as the amounts of ink remaining in the first and second ink bags decrease, and further wherein the first and second detection projections differ from each other at least in shape or color.

11. The ink cartridge as claimed in claim 10, wherein the first and second detection plates are put on surfaces of the bag main bodies of the first and second ink bags, and the plane form of each detection plate overlapping the corresponding bag main body is rectangular, wherein the width dimension of each detection plate, measured in a direction along the side where the ink outlets of the first and second ink bags are attached, is a value within the range of 0.5 to 1.0 times the width dimension of the corresponding ink bag measured in the direction along the side where the ink outlets of the first and second ink bags are attached, and further wherein the length dimension of each detection plate is a value within the range of 0.4 to 0.8 times the length dimension of each ink bag.

12. The ink cartridge as claimed in claim 11, wherein the ratio between: (i) the ratio between the width dimensions of the first and second detection plates and the width dimensions of the bag main bodies of the first and second ink bags; and (ii) the ratio between the length dimension of each detection plate and the length dimension of the bag main body of each ink bag, is within the range of 0.8 to 1.2.

13. An ink jet printer comprising:

a primary ink cartridge having a plurality of secondary ink cartridges including at least a first ink cartridge for housing a first ink bag storing first ink, and a second ink cartridge for housing a second ink bag storing second ink of a different color than the first ink, wherein one of said first and second ink cartridges further includes a waste-ink holding member for storing waste ink poured therein from the outside thereof, the plurality of secondary ink cartridges being formed in one piece by a joint mechanism for detachably joining the plurality of secondary ink cartridges;

a placement section in which said primary ink cartridge detachably is placed; and an ink jet head comprising a plurality of ink nozzle groups including a first ink nozzle group for ejecting the ink in the first ink bag of said primary ink cartridge placed in said placement section, and a second ink nozzle group for ejecting the ink in the second ink bag of said primary ink cartridge placed in said placement section, wherein the waste-ink holding member is placed in one of the first ink cartridge and the second ink cartridge having the smallest value resulting from dividing a volume of ink in each of the first and second ink bags by the number of nozzles of the ink nozzle group corresponding to the respective ink bag.

14. The ink jet printer as claimed in claim 13, wherein the waste-ink holding member has a holding capacity in the range of 1 to 1.3 times a capacity found by multiplying (i) the volume of ink available to said ink jet head as the amount of ink stored in the ink cartridge in which the waste-ink holding member is placed, by (ii) the total number of nozzles contained in the plurality of ink nozzle groups divided by the number of the ink nozzle groups for ejecting ink in the ink cartridge having the waste-ink holding member.

* * * * *